US010815761B2

(12) United States Patent
Arthur et al.

(10) Patent No.: US 10,815,761 B2
(45) Date of Patent: Oct. 27, 2020

(54) PROCESS FOR PRODUCING HYDROCARBONS FROM A SUBTERRANEAN HYDROCARBON-BEARING RESERVOIR

(71) Applicant: Cenovus Energy Inc., Calgary (CA)

(72) Inventors: John E. Arthur, Calgary (CA); Jarrett Dragani, Calgary (CA); Nadim Kassam, Calgary (CA); Michael Bumstead, Calgary (CA)

(73) Assignee: Cenovus Energy Inc., Calgary (CA)

( * ) Notice: Subject to any disclaimer, the term of this patent is extended or adjusted under 35 U.S.C. 154(b) by 293 days.

(21) Appl. No.: 16/027,114

(22) Filed: Jul. 3, 2018

(65) Prior Publication Data

US 2019/0010792 A1 Jan. 10, 2019

Related U.S. Application Data

(60) Provisional application No. 62/528,848, filed on Jul. 5, 2017.

(51) Int. Cl.
*E21B 43/16* (2006.01)
*E21B 47/07* (2012.01)
(Continued)

(52) U.S. Cl.
CPC ..... *E21B 43/168* (2013.01); *E21B 43/12* (2013.01); *E21B 43/122* (2013.01);
(Continued)

(58) Field of Classification Search
CPC .... E21B 43/168; E21B 43/166; E21B 43/164; E21B 43/2406; E21B 47/07; E21B 43/12;
(Continued)

(56) References Cited

U.S. PATENT DOCUMENTS 4,042,029 A 8/1977 Offeringa et al.
4,434,849 A 3/1984 Allen
(Continued)

FOREIGN PATENT DOCUMENTS

CA 2046107 C 12/1994
CA 2744749 A1 12/2012
(Continued)

OTHER PUBLICATIONS

Akhlaghi N., et al., "Simulation Study of GAGD process in One of Iranian Fractured Reservoir," International Journal of Scientific & Engineering Research, Jul. 2012, vol. 3 (7), 6 pages, ISSN 2229-5518.

(Continued)

*Primary Examiner* — Michael R Wills, III
(74) *Attorney, Agent, or Firm* — Borden Ladner Gervais LLP; Geoffrey deKleine

(57) ABSTRACT

A process for producing hydrocarbons from a subterranean hydrocarbon-bearing reservoir includes injecting a gas, at a pressure below a minimum miscibility pressure, into the reservoir through an injection well extending into the reservoir to form a gas zone in the reservoir. The gas injection pressure is suitable to provide a differential pressure between a bottom-hole production well pressure at a horizontal multi-lateral production well extending into the reservoir, and the gas injection pressure to facilitate sweeping the hydrocarbons toward the production well prior to gas breakthrough at the production well. The method also includes producing a portion of the hydrocarbons to surface through the production well, monitoring the production well for the gas breakthrough, and after the gas breakthrough is detected producing a further portion of the hydrocarbons by a gas gravity drainage process in which hydrocarbons are drained toward the production well, and controlling contin- (Continued)

ued production of the hydrocarbons through the production well.

18 Claims, 14 Drawing Sheets

(51) Int. Cl.

| | |
|---|---|
| ***E21B 43/12*** | (2006.01) |
| ***E21B 43/30*** | (2006.01) |
| ***E21B 43/38*** | (2006.01) |
| ***E21B 47/10*** | (2012.01) |
| *E21B 47/06* | (2012.01) |

(52) U.S. Cl.
CPC ..... *E21B 43/305* (2013.01); *E21B 43/38* (2013.01); *E21B 47/07* (2020.05); *E21B 47/10* (2013.01); *E21B 47/06* (2013.01)

(58) Field of Classification Search
CPC ..... E21B 43/122; E21B 43/305; E21B 43/38; E21B 47/10; E21B 47/06
See application file for complete search history.

(56) References Cited

U.S. PATENT DOCUMENTS

| | | | | |
|---|---|---|---|---|
| 4,441,984 | A | 4/1984 | Guerre | |
| 4,453,619 | A | 6/1984 | Bierman | |
| 4,678,036 | A | 7/1987 | Hartman et al. | |
| 4,679,627 | A | 7/1987 | Harrison | |
| 5,148,869 | A | 9/1992 | Sanchez | |
| 5,273,111 | A | 12/1993 | Brannan et al. | |
| 5,339,904 | A | 8/1994 | Jennings, Jr. et al. | |
| 5,456,315 | A * | 10/1995 | Kisman | E21B 43/247 166/245 |
| 5,899,274 | A | 5/1999 | Frauenfeld et al. | |
| 6,089,322 | A | 7/2000 | Kelley et al. | |
| 6,318,464 | B1 | 11/2001 | Mokrys | |
| 7,717,175 | B2 * | 5/2010 | Chung | E21B 43/16 166/263 |
| 8,215,392 | B2 | 7/2012 | Rao | |
| 8,770,281 | B2 * | 7/2014 | Arthur | E21B 43/30 166/245 |
| 8,851,170 | B2 | 10/2014 | Ayodele et al. | |
| 2003/0038734 | A1 * | 2/2003 | Hirsch | E21B 47/12 340/853.1 |
| 2010/0170672 | A1 | 7/2010 | Schwoebel et al. | |
| 2015/0369023 | A1 * | 12/2015 | MacPhail | E21B 33/124 166/269 |
| 2017/0030173 | A1 * | 2/2017 | MacPhail | E21B 17/1035 |
| 2017/0356275 | A1 * | 12/2017 | Wheeler | E21B 43/121 |
| 2018/0135392 | A1 * | 5/2018 | Chen | E21B 43/14 |

FOREIGN PATENT DOCUMENTS

| | | | |
|---|---|---|---|
| CA | 2876124 | A1 | 12/2013 |
| WO | 2016183001 | A1 | 11/2016 |

OTHER PUBLICATIONS

Bosworth et al., "Key Issues in Multilateral Technology," Oilfield Review, Winter 1998, vol. 10 (4), pp. 14-28.
Butler., "Gravity Drainage to Horizontal Wells," Journal of Canadian Petroleum Technology, Apr. 1992, vol. 31 (4), 7 pages.
Jadhawar et al., "Scaling and Sensitivity Analysis of Gas-Oil Gravity Drainage EOR," SPE Asia Pacific Oil and Gas Conference and Exhibition, Oct. 20-22, 2008, 14 pages.
Papatzacos et al., "Cone Breakthrough Time for Horizontal Wells," SPE Reservoir Engineering, Aug. 1991, vol. 6 (3), 8 pages, SPE-19822.
Santos et al., "An Overview of Heavy Oil Properties and Its Recovery and Transportation Methods," Brazilian Journal of Chemical Engineering , Jul.-Sep. 2014, vol. 31 (3), pp. 571-590.
Verlaan et al., "Miscible Gas-Oil Gravity Drainage," Society of Petroleum Engineers, First International Oil Conference and Exhibition in Mexico, Aug. 31-Sep. 2, 2006, 8 pages, SPE-103990.

* cited by examiner (a) Time = 3 Years (Gas Cap Expansion)

(b) Time = 7 Years (Breakthrough First Lateral, First Peak Oil Rate)

(c) Time = 10 Years (Breakthrough Second Lateral, Second Peak Oil Rate)

(a) Time = 3 Years (Gas Cap Expansion)

(b) Time = 5 Years (Breakthrough First Lateral, First Peak Oil Rate)

(c) Time = 8 Years (Breakthrough Second Lateral, Second Peak Oil Rate)

PROCESS FOR PRODUCING HYDROCARBONS FROM A SUBTERRANEAN HYDROCARBON-BEARING RESERVOIR

TECHNICAL FIELD

The present invention relates to the production of hydrocarbons from a subterranean hydrocarbon-bearing reservoir utilizing gas injection processes.

BACKGROUND

Extensive deposits of hydrocarbons exist around the world. Reservoirs of such deposits may be referred to as reservoirs of light oil, medium oil, heavy oil, extra-heavy oil, bitumen, or oil sands, and include large oil deposits in Alberta, Canada. It is common practice to segregate petroleum substances into categories that may be based on oil characteristics, for example, viscosity, density, American Petroleum Institute gravity (°API), or a combination thereof. For example, light oil may be defined as having an °API≥31, medium oil as having an °API≥22 and <31, heavy oil as having an °API≥10 and <22 and extra-heavy oil as having an °API≤10 (see Santos, R. G., et al. *Braz. J. Chem. Eng.* Vol. 31, No. 03, pp. 571-590). Although these terms are in common use, references to different types of oil represent categories of convenience, and there is a continuum of properties between light oil, medium oil, heavy oil, extra-heavy oil and bitumen. Accordingly, references to such types of oil herein include the continuum of such substances, and do not imply the existence of some fixed and universally recognized boundary between the substances.

Not all reservoirs are capable of producing oil through standard production techniques. These reservoirs may have highly viscous hydrocarbons, have one or more of low reservoir permeability, low drive energy, reservoir features such as thief zones, reservoir facies (e.g., shale breccia, heterogeneity), or a combination thereof, that do not allow for production at commercially relevant rates. For such reservoirs, various recovery techniques may be utilized to mobilize the hydrocarbons and produce the mobilized hydrocarbons from wells drilled in the reservoirs.

Oil recovery from under-pressured zones or zones that include unfavourable mobility ratios of water to oil are particularly challenging. Standard production mechanisms such as primary recovery, water flooding, polymer flooding, gas flooding and thermal Enhanced Oil Recovery (EOR) schemes may be feasible for some reservoirs but come with their own challenges and risks. A process in which gas is injected to aid in oil production may be favourable when other production mechanisms do not apply.

In any recovery process, the production rate and oil recovery are controlled by key reservoir features including permeability, porosity, oil saturation, pay thickness (a pay zone is a reservoir volume having hydrocarbons that can be recovered economically) and relative permeability effects. Furthermore, key factors controlling exploitation include pay thickness, reservoir volume (areal extent), stress state, reservoir pressure, well completion processes and accessibility by vertical or horizontal wells. Understanding of the reservoir may be improved by drilling stratigraphic wells, cutting core, running petrophysical logs, acquiring seismic data, and conducting detailed lab studies. However, reservoir characterization does not change the rock properties of a reservoir. Different production mechanisms may result in differing oil recovery. Thus the recovery process determines the production capability of a reservoir and its economic viability.

Improvements in oil production utilizing gas injection processes are desirable.

SUMMARY

According to an aspect of an embodiment, a process for producing hydrocarbons from a subterranean hydrocarbon-bearing reservoir is provided. The process includes injecting a gas, at a pressure below a minimum miscibility pressure, into the reservoir through an injection well extending into the reservoir to form a gas zone in the reservoir. The gas injection pressure is suitable to provide a differential pressure between a bottom-hole production well pressure at a horizontal multi-lateral production well extending into the reservoir, and the gas injection pressure, to facilitate sweeping the hydrocarbons toward the production well prior to gas breakthrough at the production well. The process also includes producing a portion of the hydrocarbons to surface through the production well, monitoring the production well for the gas breakthrough, and after the gas breakthrough is detected producing a further portion of the hydrocarbons by a gas gravity drainage process in which hydrocarbons are drained toward the production well, and controlling continued production of the hydrocarbons through the production well.

Controlling continued production of the hydrocarbons may include at least one of: re-completing a lateral of the horizontal multi-lateral production well, isolating the lateral of the horizontal multi-lateral production well, installing an inflow control device in the lateral of the horizontal multi-lateral production well, re-drilling a section of the lateral of the horizontal multi-lateral production well, re-drilling the horizontal multi-lateral production well, re-drilling a section of the injection well, shutting-in production from the horizontal multi-lateral well to continue sweep at an adjacent production well, or a combination thereof.

Re-completing may include re-sizing a lift assembly for pumping produced fluids (e.g. Progressive Cavity Pump, Electric Submersible Pump), installing a downhole gas separator, implementing a gas lift process (e.g., natural lift, or induced gas lift with multiple tubing strings or gas ports or gas lift mandrels), installing a separate tubing string within the well to divert flow from a lateral of the well, or a combination thereof.

Monitoring the production well for the gas breakthrough may include monitoring at least one of: a producing gas to oil ratio (GOR), a hydrocarbon production rate, a water production rate, a gas injection rate, a gas production rate, an injection pressure, a production pressure, a production temperature, a lift assembly performance (e.g. Progressive Cavity Pump torque, Electric Submersible Pump amp fluctuations), or a combination thereof.

Gas breakthrough may be detected by analyzing monitored data obtained from at least one of a seismic survey, an observation well, a production log (e.g., spinner logs, temperature logs, caliper logs), an injection well-production well communication test, a shut-in test to monitor pressure response in the injection or production well, or a combination thereof.

The bottom-hole production well pressure may be reduced, a rate of gas injection may be increased, or a combination thereof, to facilitate sweeping the hydrocarbons toward the production well prior to gas breakthrough.

The production well may be monitored prior to injecting the gas and, in response to first production of hydrocarbons through the production well, the gas injection is commenced.

According to another aspect of an embodiment, a process is provided for removing fluids from a hydrocarbon reservoir utilizing an injection well extending into the hydrocarbon reservoir and a production well extending near a bottom of the reservoir. The process includes injecting a gas into the reservoir through the injection well, at a pressure to form a gas zone in the reservoir and facilitate sweeping of the fluids to the production well, recovering a portion of the fluids through the production well, and, in response to detecting gas breakthrough to the production well, recovering a further portion of the fluids by drainage of the further fluids toward the production well.

BRIEF DESCRIPTION OF THE DRAWINGS

Embodiments of the present invention will be described, by way of example, with reference to the drawings and to the following description, in which.

DETAILED DESCRIPTION

Figure 1A:
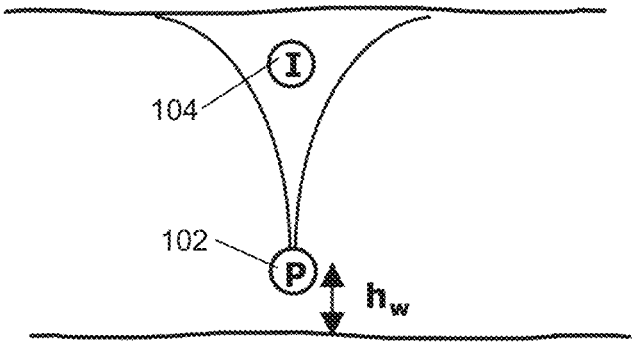
FIG. 1A is a schematic sectional view through a reservoir and shows the relative location of an injection well and a production well with no lateral offset.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

The disclosure generally relates to a process for producing hydrocarbons from a subterranean hydrocarbon-bearing reservoir. The process includes injecting a gas, at a pressure below a minimum miscibility pressure, into the reservoir through an injection (injector) well extending into the reservoir to form a gas zone in the reservoir. The gas injection pressure is suitable to provide a bottom-hole differential pressure between the injector well and a bottom-hole production (producer) well to facilitate sweeping the hydrocarbons toward the production well prior to gas breakthrough at the production well. The production well is a horizontal multi-lateral well that may be located near the base of the pay zone or higher in the pay zone depending on reservoir features. The method also includes monitoring the production well for the gas breakthrough, and after the gas breakthrough is detected, producing a further portion of the hydrocarbons by selective processes applied to the horizontal multi-lateral production well or the injection well, or both the production well and the injection well. The processes are aimed at oil production and recovery through continued gas gravity displacement (GGD) through unswept portions of the reservoir. Minimum miscibility pressure is defined as the lowest pressure at which miscibility between fluids is achieved with no interfacial tension between the fluids.

The GGD process utilizes gas expansion, buoyancy, and gravity drainage drive mechanisms to improve oil production and oil recovery. The process involves placing a vertical or horizontal gas injection well at the top of a pay zone. A horizontal production well is placed near the base of the pay zone. The injection well may be placed directly above the production well, or offset a certain lateral distance. Well stimulation by means of acidizing to reduce well skins or fracturing to increase reservoir access are also viable options for the recovery process.

In the GGD process, gas injection begins at first oil production, or may be implemented later in the production time. Gas injection may be continuous or implemented in batch sequences (cycles). Oil production may occur continuously. However the process does not require both injection and production to occur continuously or simultaneously. As gas injection occurs, a gas zone forms around the injection well and grows in size with time. The shape and size of the gas zone varies depending on the well configuration, geological features of the reservoir, the fluid and rock properties of the reservoir, and the rate of gas injection and oil production. Different gases may be used in the process and include, for example, natural gas, methane, natural gas liquids (NGLs), carbon dioxide, air, nitrogen, or steam. The selection of gas depends on the nature of the reservoir. In addition, water, a foam or other chemical additives may be utilized prior to or after gas breakthrough to the production well.

The drive mechanisms of the process vary in magnitude depending on the nature of the reservoir and operating conditions for the process. Gas injection pressures close to the reservoir pressure result in the development of a gas zone at or close to the static reservoir pressure in the oil zone (far away from the production well). In this circumstance the drive mechanism is a combination of an induced gas cap drive (also called expansion drive as a result of the gas zone) and gas gravity drainage. Gas injection pressures substantially above the static reservoir pressure result in a drive mechanism primarily dominated by gas expansion. The gravity drainage mechanism is initiated by lowering the pressure at the production well and is supported by the density difference between the injected gas and oil (buoyancy). The larger the density differential, the greater the tendency for the gas zone to expand vertically and induce gravity drainage for oil.

Eventually, a path is formed for the injected gas to enter the production well, referred to as gas breakthrough. After gas breakthrough occurs, the drive mechanism becomes almost entirely dominated by gravity drainage. Oil production rates are typically limited once gas breakthrough occurs as higher drawdown pressures at the production well result in higher gas production rates.

In a conventional oil reservoir with an overlying gas cap, oil rates under primary production are limited after gas breakthrough occurs to the production well. Prior to gas breakthrough, oil rates are controlled by drawdown and the reservoir drive mechanisms. Drawdown, as referred to herein, is the difference between the flowing bottom-hole pressure in the production well ($P_{wf}$) and the static reservoir pressure. In the GGD process, a displacement (differential) pressure is the difference between $P_{wf}$ and the injection pressure in the gas zone ($P_{inj}$). A high displacement pressure results in high oil rates prior to gas breakthrough. This is a result of increased energy in the system and greater drive through gas expansion.

After gas breakthrough occurs at the production well, the dynamics begin to behave similarly to a conventional oil reservoir with an overlying gas cap in that oil production becomes limited. Different strategies may be implemented to manage gas production, increase the rate of gas recovery, and provide high oil recovery. Increasing gas production after gas breakthrough may be favorable to increase the rate of gas recovery or depressurize the depleted reservoir zone. After gas breakthrough occurs at the production well, oil rates are limited by gravity drainage (the density differential between gas and oil) and increasing gas production does not substantially increase oil production. Excessive gas production may cause bottlenecks for well equipment, gathering systems and processing facilities. Oil production may continue utilizing the gas breakthrough for gas lift or natural lift in the wellbore. Alternatively, pressures may be managed by limiting gas production, shutting-in the production well, or drilling new wells or laterals (also referred to as legs or branches). In the case of a production well with multiple horizontal laterals, the gas breakthrough is expected to occur at the outermost laterals or the lateral(s) in closest proximity to the injection well. Although oil production from the outer laterals may be limited by gravity drainage, the inner laterals may continue to produce oil utilizing the expansion drive mechanism. In such a situation, gas production in the outer laterals may not cause bottlenecks for the well equipment or surface facilities.

To continue production utilizing the inner laterals for an extended period of time, the outer laterals may be isolated. Eventually, gas breakthrough occurs across other lateral sections but not until further oil production is realized.

The GGD process operates continuously until gas breakthrough occurs in the production well and the gas becomes unmanageable or renders the process uneconomic. At such a time, gas injection is discontinued and oil production continues in a process similar to a reservoir with an overlying gas cap. Gas may be quickly recovered from the reservoir, or slowly recovered and utilized as a gas cap drive for infill well drilling in unswept regions of the reservoir. The gas may be generally soluble in oil, but the rates and pressures utilized inhibit large volumes of gas from dissolving into the oil.

Figure 1B:
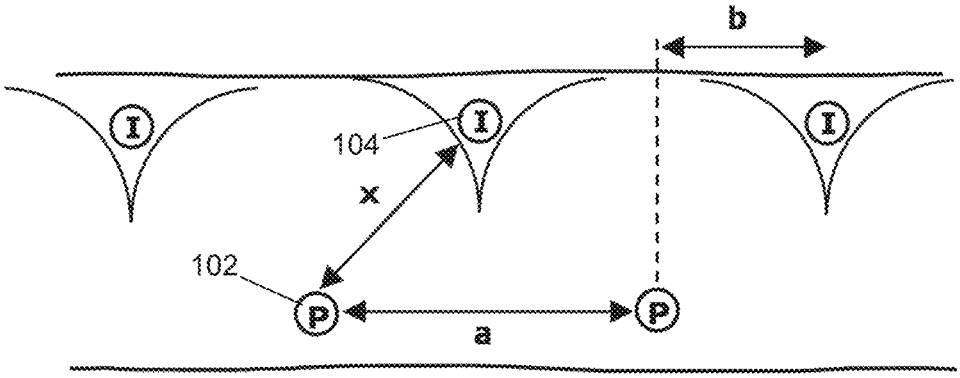
FIG. 1B is a schematic sectional view through a reservoir and shows the relative locations of injection wells and production wells with lateral offset.
Figure 1C:
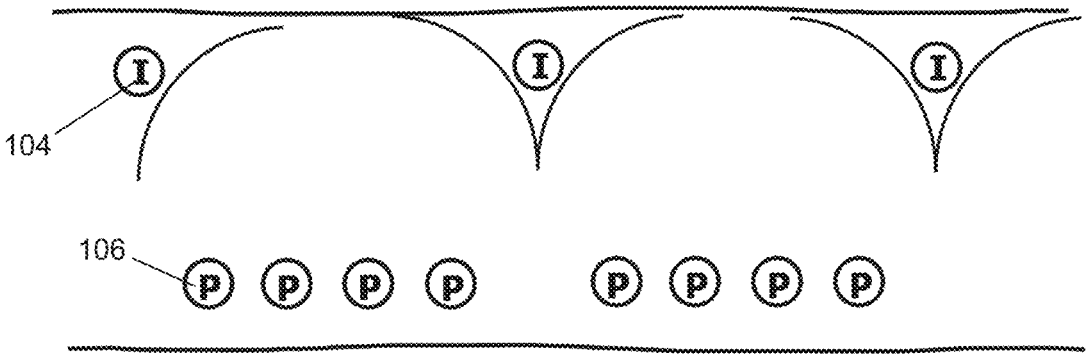
FIG. 1C is a schematic sectional view through a reservoir and shows the relative location of injection wells and laterals of horizontal multi-lateral production wells with lateral offset.

Illustrations of well locations for GGD processes are shown in FIG. 1A through FIG. 1C. FIG. 1A shows an end view (looking into the wells) of a production well 102 and an injection well 104, each having a single lateral wellbore, and generally stacked such that the lateral, or horizontal segment of the injection well 104 extends generally above the lateral, or horizontal segment of the production well 102. The well height (distance) of the production well 102 from the base of the reservoir is shown as $h_w$. FIG. 1B shows two separate production wells 102 and three separate injection wells 104, each having single laterals. The wells are offset such that the lateral, or horizontal segment of the production wells 102 extend below and generally laterally between two separate injection wells 104. The distance to the gas zone along a straight line between one of the production wells 102 and one of the offset injection wells 104 is shown as "x". The distance (spacing) between the two separate production wells 102 is shown as "a". FIG. 1C shows two production wells, each with four laterals 106 and three separate injection wells 104, each having single laterals. The wells are offset such that the four laterals 106 of the production well extend below and generally laterally from the injection wells 104.

Modelling

To demonstrate the GGD process and understand the process mechanisms, numerical simulation models were conducted utilizing black oil in conventional reservoir rock with a permeability in the range of 1-1,000 mD.

Figure 2:
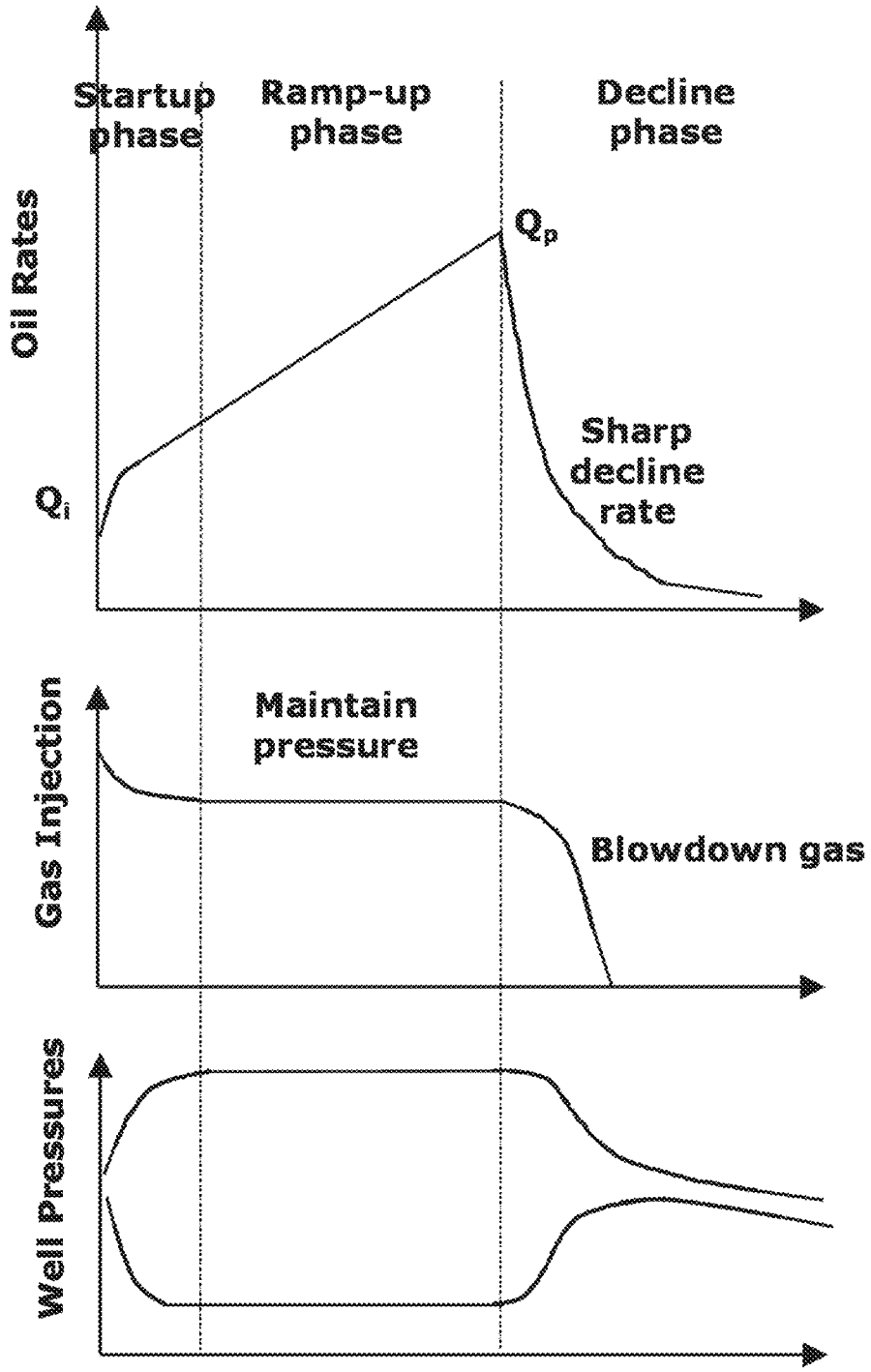
FIG. 2 shows graphs of oil production rate, gas injection rate and well pressure over time during phases of production.

Several simulations were conducted for the purpose of understanding the process and quantifying the impact of different input parameters on results. For the purpose of these simulations, gas injection via the injection well and oil production from the production well commenced simultaneously at the beginning of the simulation. Gas injection and oil production were continuous until gas breakthrough occurred at the production well, at which point gas injection was stopped. Graphs of production rate, gas injection rate and well pressure over time during phases of production in GGD according to the simulations are shown conceptually in FIG. 2.

The graphs illustrate three different phases in the life of a GGD well. The start-up (startup) phase includes commencing gas injection and increasing reservoir pressure to a target pressure. The ramp-up phase includes steady gas injection and increasing oil production under constant bottom-hole pressure conditions. Finally, the decline phase includes a rapid decrease in oil production associated with gas breakthrough and loss of the expansion drive mechanism. Gas injection is curtailed and gas may be slowly or quickly recovered.

Figure 3:
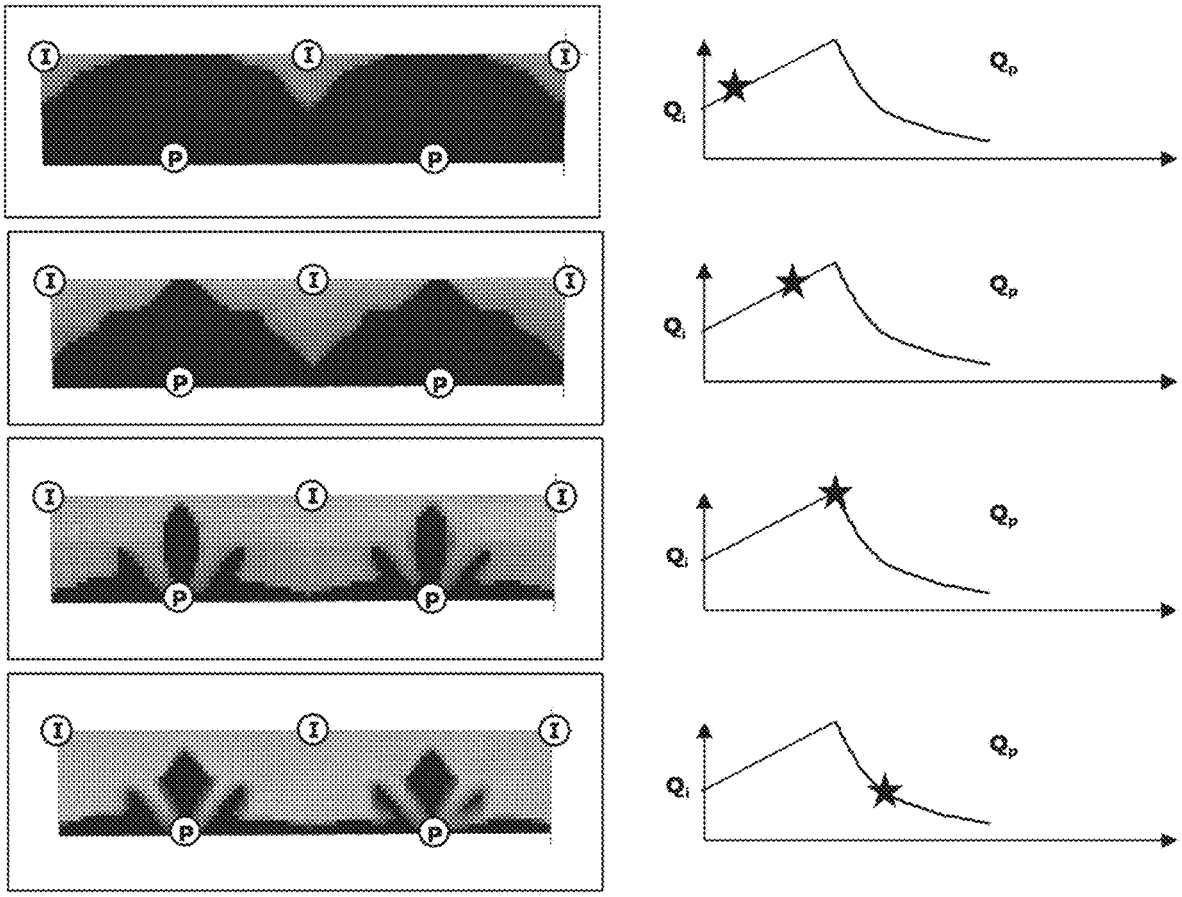
FIG. 3 illustrates gas saturation and associated oil production profiles before and after gas breakthrough from simulations of a process for producing hydrocarbons from a subterranean hydrocarbon-bearing reservoir according to an embodiment.

FIG. 3 illustrates gas saturation from simulations of a GGD process for a single lateral model and corresponding graphs illustrating oil rate over time. The graphs illustrate key reference points in the GGD process. Time to coalescence is the time at which the gas zones from independent injection wells merge together (second row from top in FIG. 3). Time to breakthrough corresponds to the time at which gas breakthrough is observed at the production well (third row from top in FIG. 3). Initial production rate ($Q_i$) is the initial oil rate for the well, and is similar or the same as the initial oil rate during primary production. Peak production rate ($Q_p$, indicated by a star) is the maximum oil rate (at the conditions of the simulation) for the production well, and coincided in each case with time to breakthrough. After breakthrough occurred, the oil rate declined rapidly and began to stabilize at a production rate similar to that expected for the same reservoir with an overlying gas cap. This production rate is the critical production rate and determined the drawdown that was feasible for the production well without incurring excessive gas production (gravity drainage dominated).

The simulation models showed that the start-up phase of the well life was relatively short, typically on the order of 3 months or less depending on injection pressures. Therefore, although the start-up phase is identified as a phase in the well life, improvement in the start-up phase is not considered to significantly impact hydrocarbon production because of the short duration and relatively low cumulative oil production during this phase.

Modelling was carried out to compare the strategies for the decline phase of the well life (post-breakthrough) for a single horizontal production well lateral with a single horizontal injection well lateral. The scenarios tested included the following:

"open-flow" of the production well with no rate restrictions at a constant bottom-hole pressure;

constrained production to a gas phase rate constraint (similar to a pump-off or fluid level controller); and use of breakthrough gas for gas lift until pressures declined to below lifting capability, then constrained production to a gas phase rate constraint.

The modelling showed little change in oil production regardless of the production strategy. However, the critical production rate was correlated to the density differential of the gas and oil multiplied by the gravity constant. This representation of the critical rate supports the domination of the gravity drainage drive mechanism during the decline phase. The only substantial difference between the decline simulations was the speed of the gas recovery and pace of decline of the reservoir pressure. Both of these were more affected by reservoir management strategies as opposed to oil production. Increasing oil recovery in the GGD process prior to breakthrough helps improve the economic value of the process.

In order to provide high oil recovery, a longer time to breakthrough ($t_{BT}$) and a high peak oil rate ($Q_p$) are desirable. Using the same simulation models described above, input parameters were varied and correlated against $t_{BT}$ and $Q_p$. Input parameters included:

Injection pressure, $P_{inj}$;

Reservoir pressure, $P_{res}$;

Flowing bottom-hole pressure on the production well, $P_{wf}$;

Vertical permeability $k_V$ & horizontal permeability $k_H$;

Vertical well spacing between injection and production wells;

Lateral offset between injection and production wells; and

Use of multi-lateral production wells.

The results showed that a higher gas injection pressure ($P_{inj}$–$P_{res}$) increased $Q_p$ but also increased $t_{BT}$. Decreasing drawdown ($P_{res}$–$P_{wf}$) also increased $Q_p$ and decreased $t_{BT}$. The relative response for each simulation was different and the relationship between $t_{BT}$ and drawdown was not linear, but instead followed that of a power law.

Comparing permeability, it was found that $t_{BT}$ was inversely proportional to $k_V k_H$, whereas $Q_p$ was directly proportional to $k_V k_H$. Similarly, $t_{BT}$ was directly proportional to well spacing and $Q_p$ was inversely proportional to well spacing. Such results may indicate that $t_{BT}$ and $Q_p$ are inversely proportional to each other, as any attempt to increase $Q_p$ was done at the expense of $t_{BT}$.

Based on modelling, the peak oil rate closely correlates with the pressure gradient between the gas zone and the production well. This was quantified as dP/dx, where x is the distance to the gas zone along a straight line between the production well and the injection well and dP is the differential pressure between the injection well and the production well ($P_{inj}$–$P_{wf}$). The term dP/dx is also referred to herein as the potential gradient. The close correlation of peak oil rate with potential gradient explains why the oil production rate increases to a maximum that corresponds with the gas breakthrough time. As used herein, terms such as maximum or peak are dependent on the particular conditions of the simulation or hydrocarbon recovery operation to which the terms refer. The potential gradient is dependent on $P_{inj}$, $P_{wf}$, and the expansion of the induced gas zone. With $P_{inj}$ and $P_{wf}$ maintained constant, as held in the simulations, the increased oil production is associated with the increase in the potential gradient as the distance between the gas zone and production well approaches zero. After gas breakthrough, the potential gradient was no longer determined by dP/dx and, instead, was dominated by the gravity drainage component referred to herein as $\Delta\rho g$. The gravity drainage term is always part of the potential gradient, but is only a small part of the drive mechanism during a ramp-up phase of GGD where the injection pressure is substantially larger than the static reservoir pressure.

Based on modelling, it was determined that a greater vertical well spacing, also referred to as vertical stand-off between the injection well and the production well, results in improved production and increases the time to gas breakthrough. Numerical simulation models were conducted utilizing black oil in conventional reservoir rock with a permeability in the range of 1-1,000 mD. Simulations were performed to assess the impact of changing the vertical distance (H) between a horizontal segment of the injection well and a horizontal segment of the production well. Two vertical distances of 5 m and 23 m were simulated with the results shown in Table 1. Five test cases were simulated, with the differential pressure (dP, between the bottom-hole production well pressure and the gas injection pressure) being varied between 50 kPa and 200 kPa. Results indicated that peak oil rate increased with an increase in a) pressure, for example from 79 bbl/day at 50 kPa to 100 bbl/day at 100 kPa, both at a vertical distance of 5 m between the wells; and b) vertical distance, for example from 100 bbl/day at 100 kPa and a vertical distance of 5 m to 113 bbl/day at 100 kPa and a vertical distance of 23 m.

TABLE 1

Vertical Stand-off Simulation Results

| Test Case | dP (kPa) | Injector Position (m above Producer) | Cum Oil (MMbbl) | Peak Oil Rate (bbl/day) | Cum GOR ($m^3/m^3$) | Gas Recycle Ratio (%) |
|---|---|---|---|---|---|---|
| 1 | 50 | 5 | 0.421 | 79 | 596 | 109 |
| 2 | 100 | 5 | 0.441 | 100 | 1730 | 103 |
| 3 | 50 | 23 | 0.446 | 89 | 794 | 106 |
| 4 | 100 | 23 | 0.463 | 113 | 1483 | 103 |
| 5 | 200 | 23 | 0.472 | 141 | 1981 | 102 |

P = pressure;
Cum = cumulative;
MM = millions;
bbl = barrels;
GOR = gas to oil ratio Analytical While reservoir simulators were utilized to perform modeling studies of GGD, analytical approaches may also provide a way to rapidly study such EOR techniques. Equations describing the flow of gas in the reservoir may be solved for pressure distribution in the reservoir. These equations allow the explicit evaluation of the effect of pressure increase on oil production until gas breakthrough at the production well.

The following assumptions were made for the purpose of providing analytical solutions:

1. The reservoir is isotropic;
2. The injection well and the production well are horizontal;
3. Gas is injected at the top of the formation;
4. No flow boundary at base of reservoir; and
5. The gas diffusivity equation is linearizable.

Figure 4:
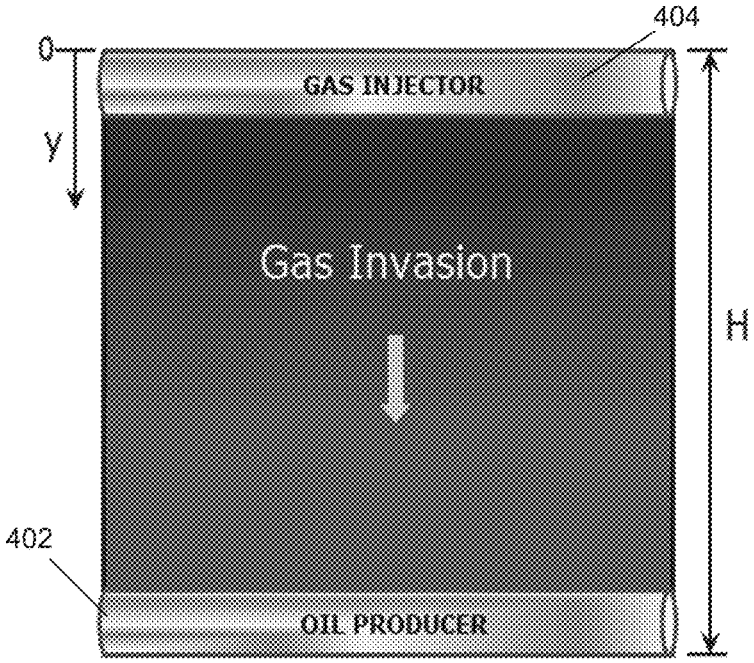
FIG. 4 is a schematic view of a reservoir and shows the relative locations of an injection well and a production well.

The equations were tested against the results of 2D reservoir simulations. FIG. 4 is a schematic of the reservoir and shows the relative locations of the injection well 404 and production well 402. The injection well 404 is located at the top of the reservoir while the production well 402 is located at the bottom. H is the distance between the two wells.

Based on the foregoing assumptions, the pressure distribution in the reservoir resulting from gas injection was described by the one dimensional diffusivity equation (1) for gas flow. Two boundary conditions were used: a constant injection pressure boundary and a constant mass flux boundary.

$$\frac{\partial^2 P^2}{\partial y^2} = \frac{\phi \mu_g C_t}{K} \frac{\partial P^2}{\partial t} \tag{1}$$

Figure 5:
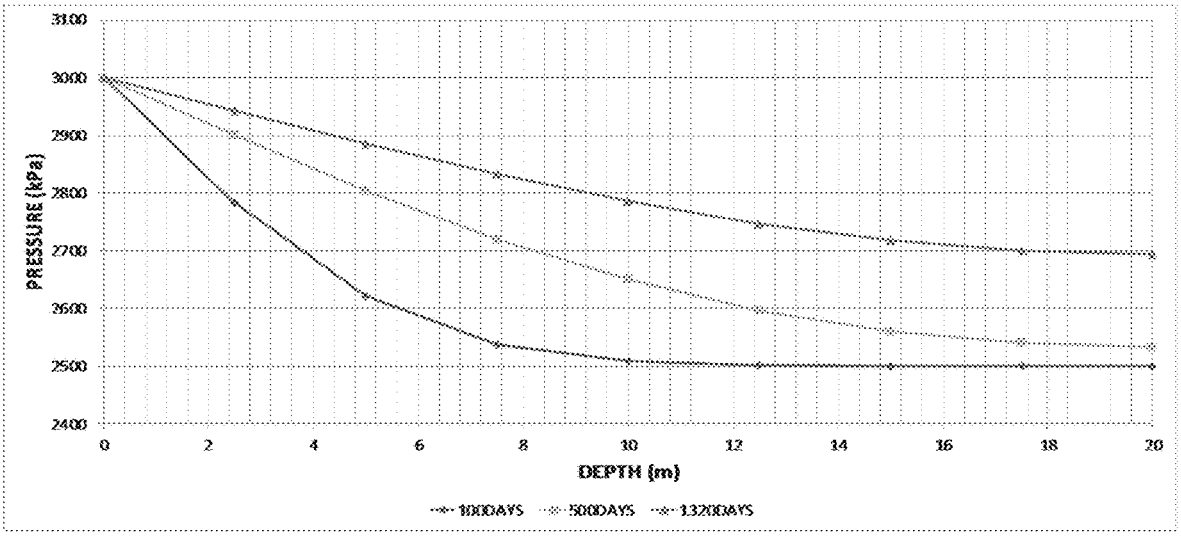
FIG. 5 is a graph illustrating reservoir pressure profiles at different times for a 20 m reservoir having an initial pressure of 2,500 kPa and at a gas injection pressure of 3,000 kPa.
Figure 6:
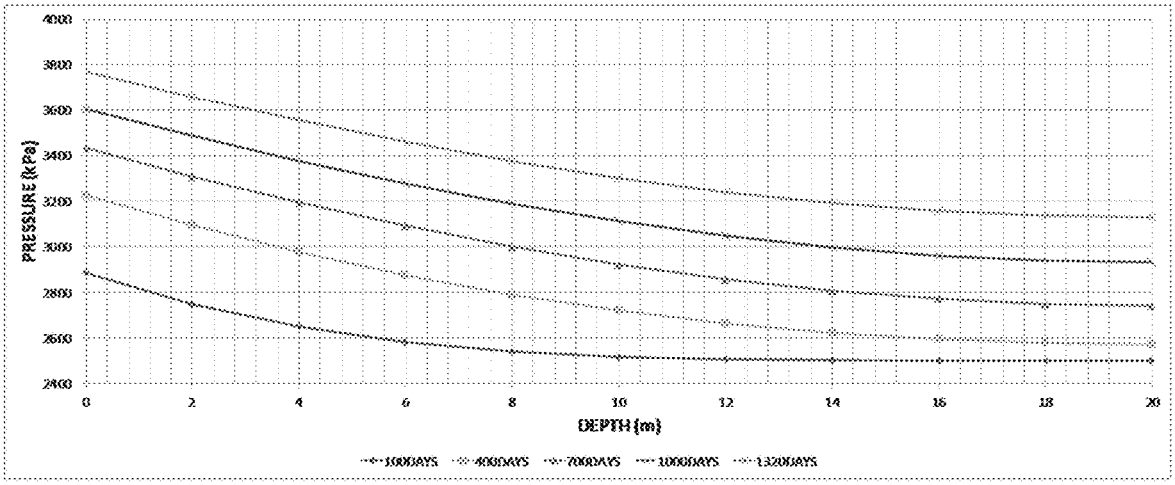
FIG. 6 is a graph illustrating reservoir pressures profiles at different times for a 20 m reservoir having an initial pressure of 2,500 kPa and at an injection rate of 30 tonnes/day of gas.

The pressure distribution in the reservoir corresponding to a constant injection pressure of 3,000 kPa is shown in FIG. 5. Pressure profiles as a function of time for a constant mass injection rate of 30 tonnes/day are shown in FIG. 6.

Comparison with 2D Reservoir Simulation Results

Figure 7:
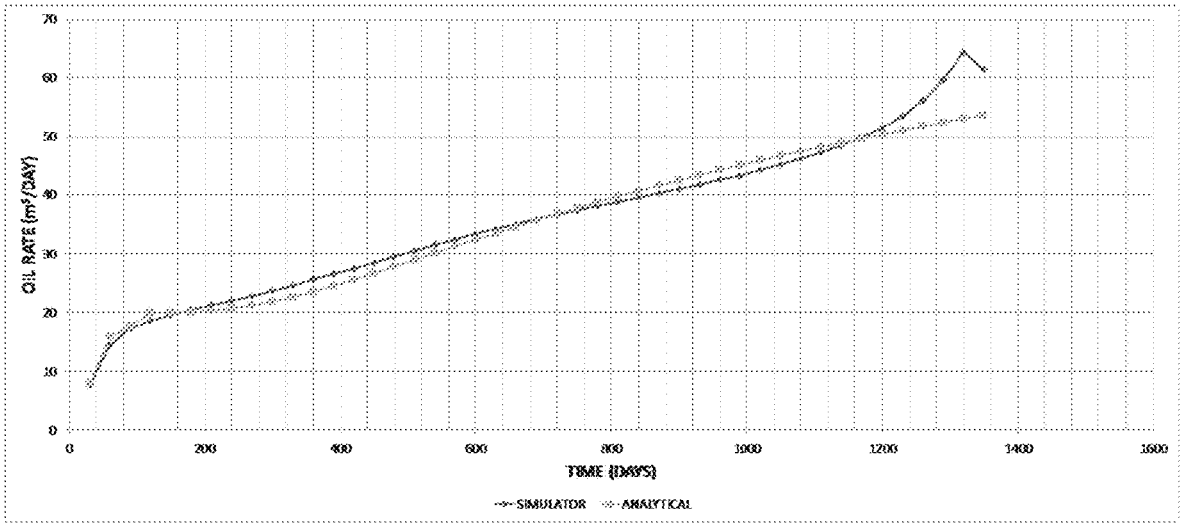
FIG. 7 is a graph illustrating oil production rate over time for a 20 m reservoir at an injection rate of 30 tonnes/day of gas.

The oil production rates corresponding to the reservoir pressure increase due to gas injection are compared with the oil rates from 2D simulation in FIG. 7. The oil and water production rates corresponding to a gas injection rate of 30 tonnes/day were calculated from equations (2) and (3).

$$q_o = \frac{K_o A}{B_o \mu_o}\left(\frac{dP}{dy} + \rho_o g\right) \tag{2}$$

$$q_w = \frac{K_w A}{B_w \mu_w}\left(\frac{dP}{dy} + \rho_w g\right) \tag{3}$$

The volumetric gas production rate, $q_{gprod}$ was calculated from an assumed gas to oil ratio (GOR). The volumetric gas injection rate, $q_{ginj}$ was calculated from the gas mass injection rate.

Material Balance

Material balance considerations were also utilized to obtain an average reservoir pressure based on steady state or pseudo-steady state reservoir behavior. The pseudo-steady state behavior was given by equation (4):

$$q_{gINJ} - q_{gPROD} - q_o - q_w = C_t V \frac{dP}{dt} \tag{4}$$

Where the total compressibility was calculated from equation (5):

$$C_t = S_o C_o + S_w C_w + S_g C_g + C_r \tag{5}$$

The oil rate comparison between the simulation and analytical model shown in FIG. 7 indicates that this analytical model can be utilized to predict oil recovery from gas injection EOR with reasonable accuracy.

Nomenclature

Nomenclature for the analytical equations (1)-(5) is shown in Table 2.

TABLE 2

Nomenclature for Analytical Equations

| Symbol | Units | Representation |
|---|---|---|
| A | $m^2$ | Area |
| $B_o$ | $m^3/m^3$ | Formation volume factor |
| $C_t$ | 1/kPa | Total compressibility |
| g | — | Gas |
| g | $m/s^2$ | Gravity |
| K | $m^2$ | Permeability |
| o | — | Oil |
| P | kPa | Pressure |
| q | $m^3/s$ | Rate |
| r | — | Reservoir |
| ρ | $kg/m^3$ | Density |
| S | % | Saturation |
| t | sec | Time |
| V | $m^3$ | Volume |
| y | m | Depth |
| ϕ | % | Porosity |
| μ | Pa · s | Viscosity |
| w | — | Water |

Use of Multi-Lateral Wells

The use of multi-lateral production wells was determined to improve hydrocarbon production utilizing the GGD process. Multi-lateral wells are generally categorized as vertical and deviated multi-laterals or horizontal multi-laterals. Further, multi-laterals are identified by completion type: uncased (open-hole), cased, and uncased but segregated (e.g.

isolation packers between intervals for fracture stages). Examples of different multi-lateral production wells are shown in FIG. 8A and FIG. 8B.

Figure 8A:
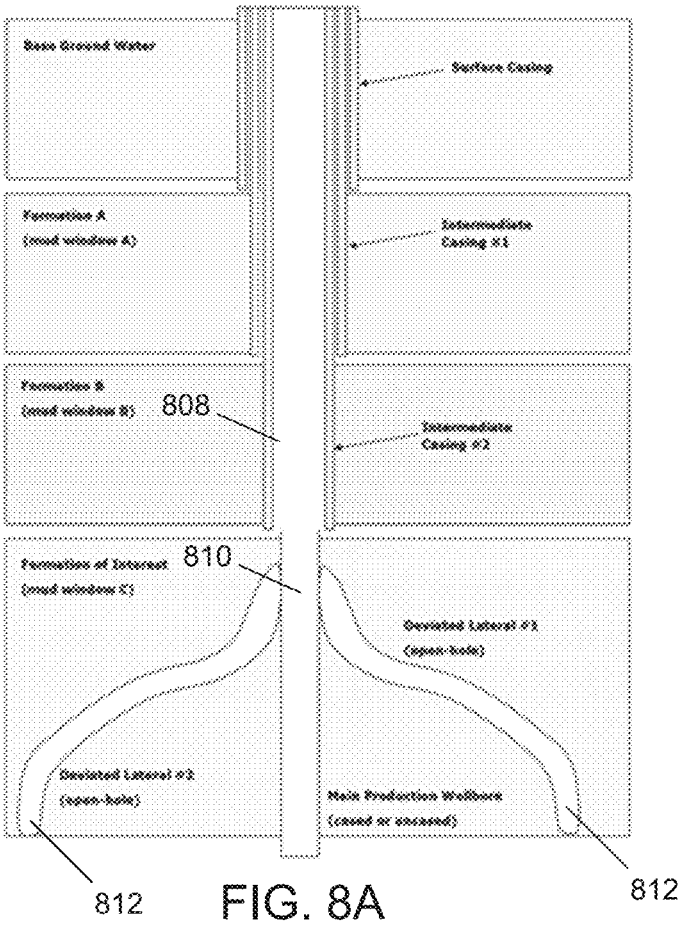
FIG. 8A and FIG. 8B are schematic views of examples of multi-lateral wells.
Figure 8B:
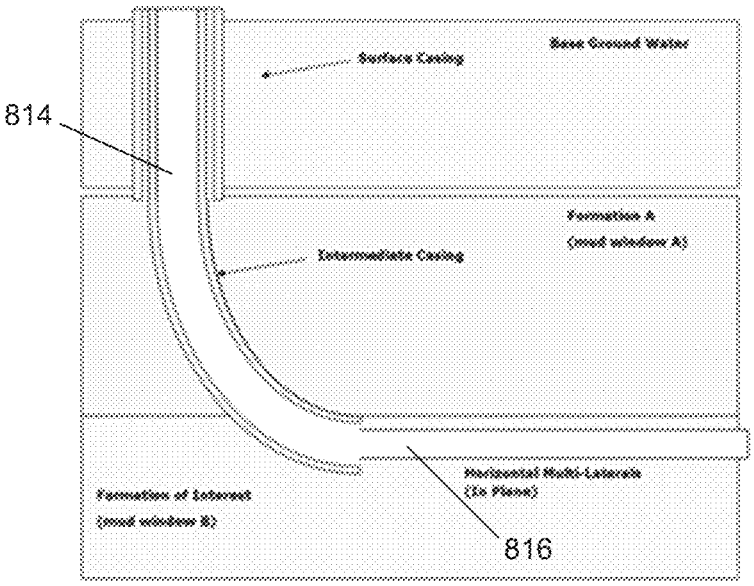

FIG. 8A shows a front view of a production well 808 with a main vertical bore 810 and two deviated laterals 812 for intersecting different parts of the reservoir or different formations. In this example, the deviated laterals 812 are left open-hole. FIG. 8B shows a side view of a production well 814 with multiple laterals 816 extending generally parallel to each other.

The use of horizontal multi-lateral production wells was determined to provide the most benefit to hydrocarbon production as the laterals of the horizontal multi-lateral production well increase the effective inflow area from the reservoir during the GGD process. Horizontal multi-lateral wells may also be utilized for injection wells in the GGD process. The injection well may be a vertical, deviated, horizontal, or multi-lateral well.

Figure 9A:
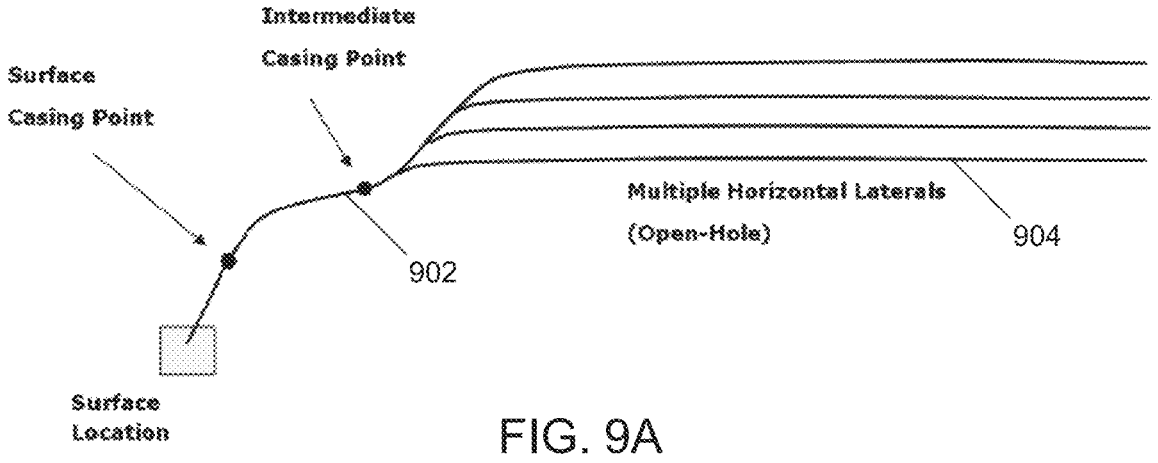
FIG. 9A and FIG. 9B are schematic views of examples of horizontal multi-lateral well configurations.
Figure 9B:
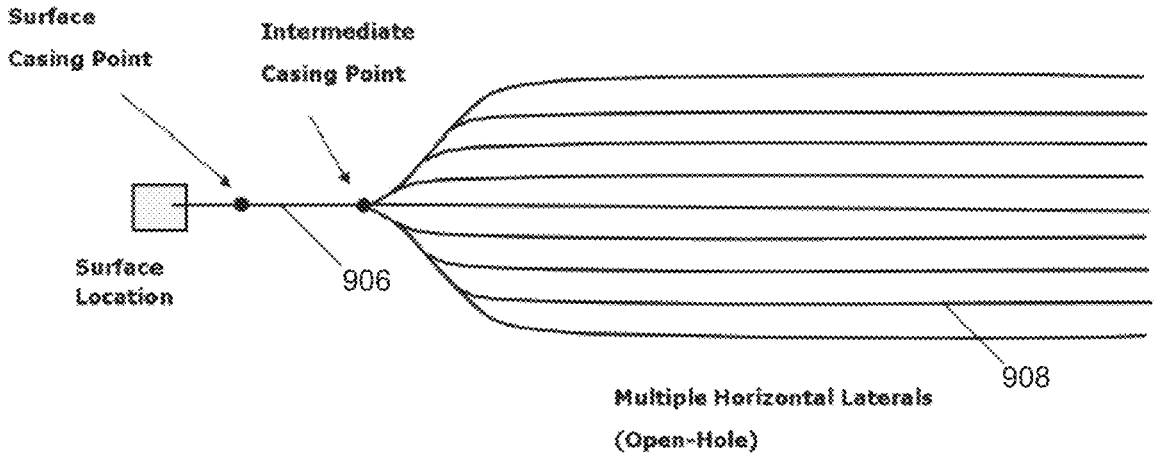
Figure 10A:
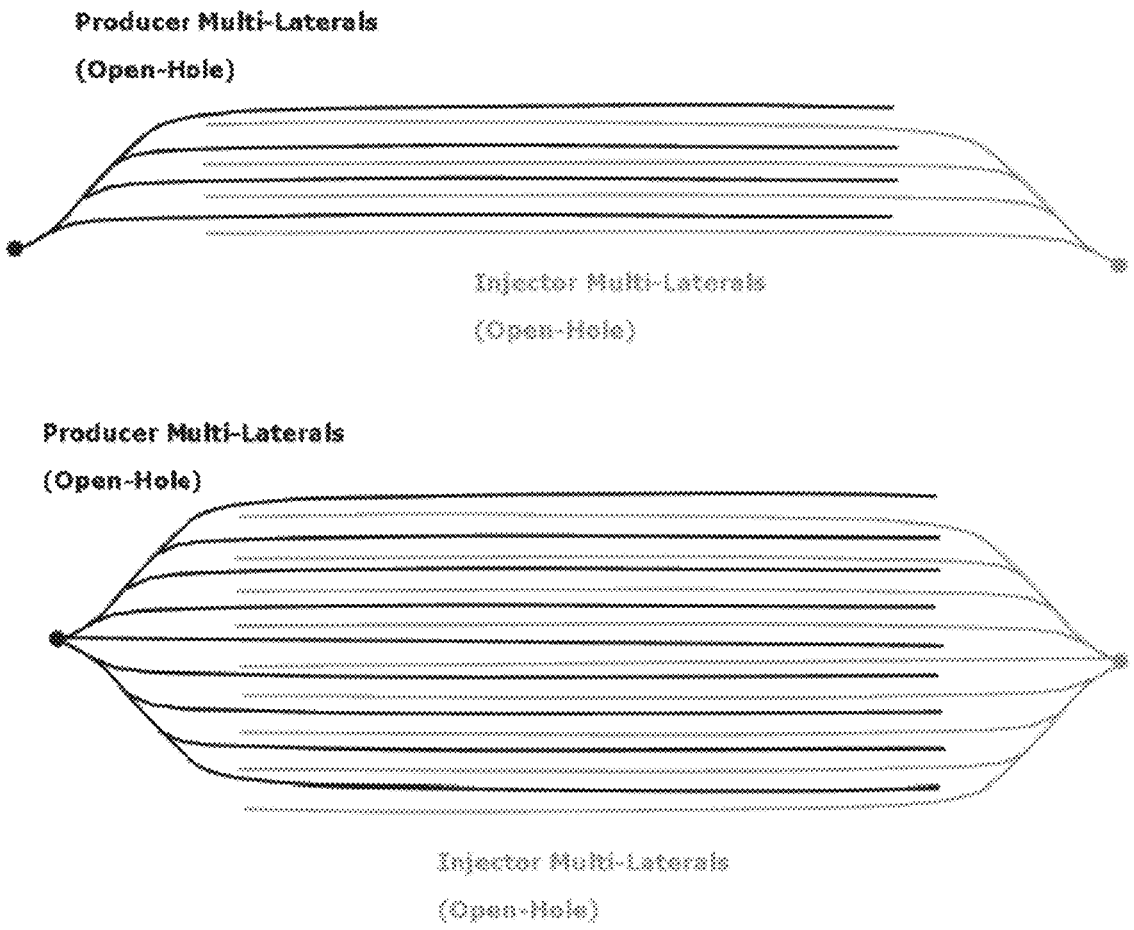
FIG. 10A, FIG. 10B, and FIG. 10C are schematic views of examples of injection well and horizontal multi-lateral well configurations.
Figure 10B:
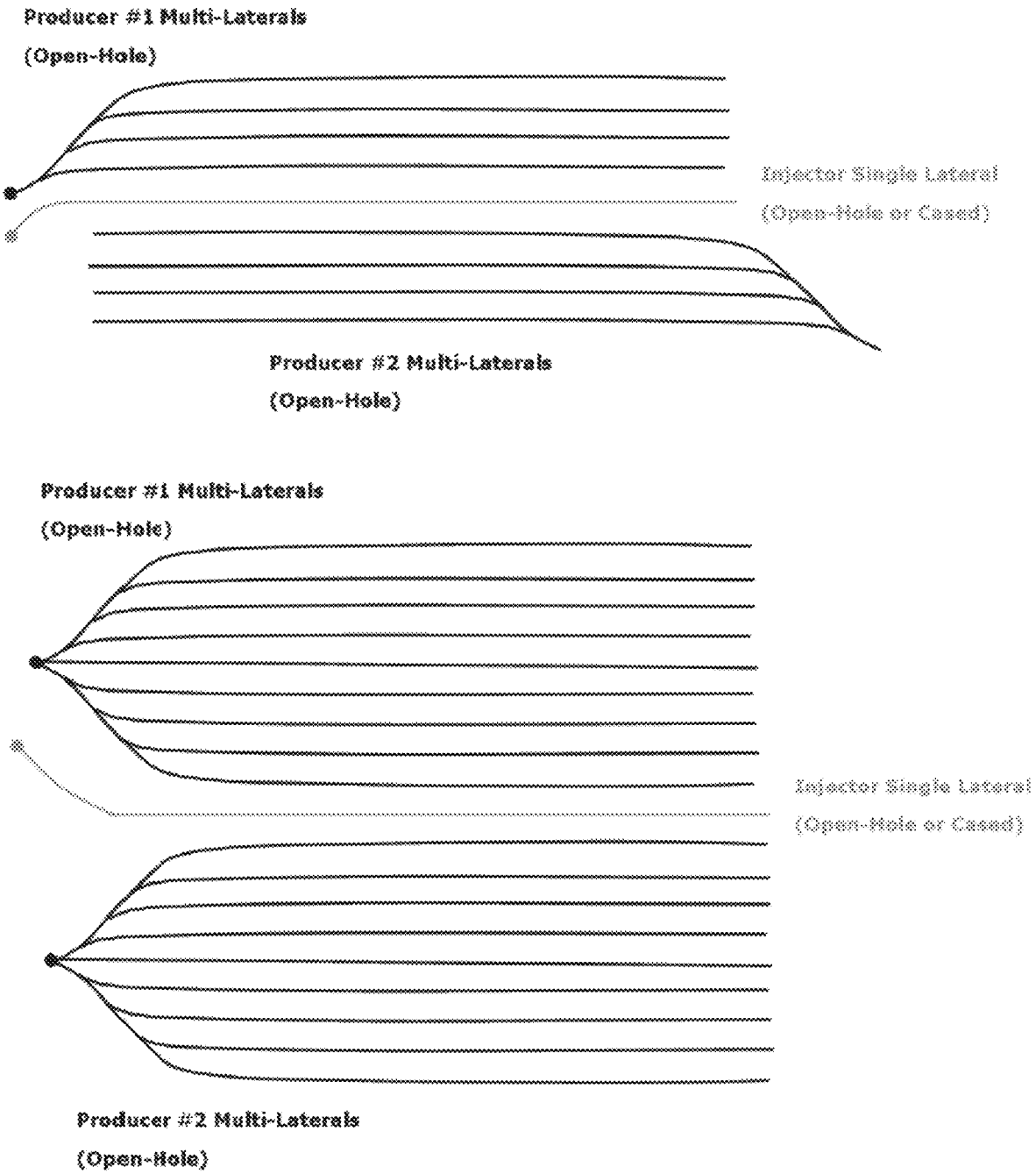
Figure 10C:
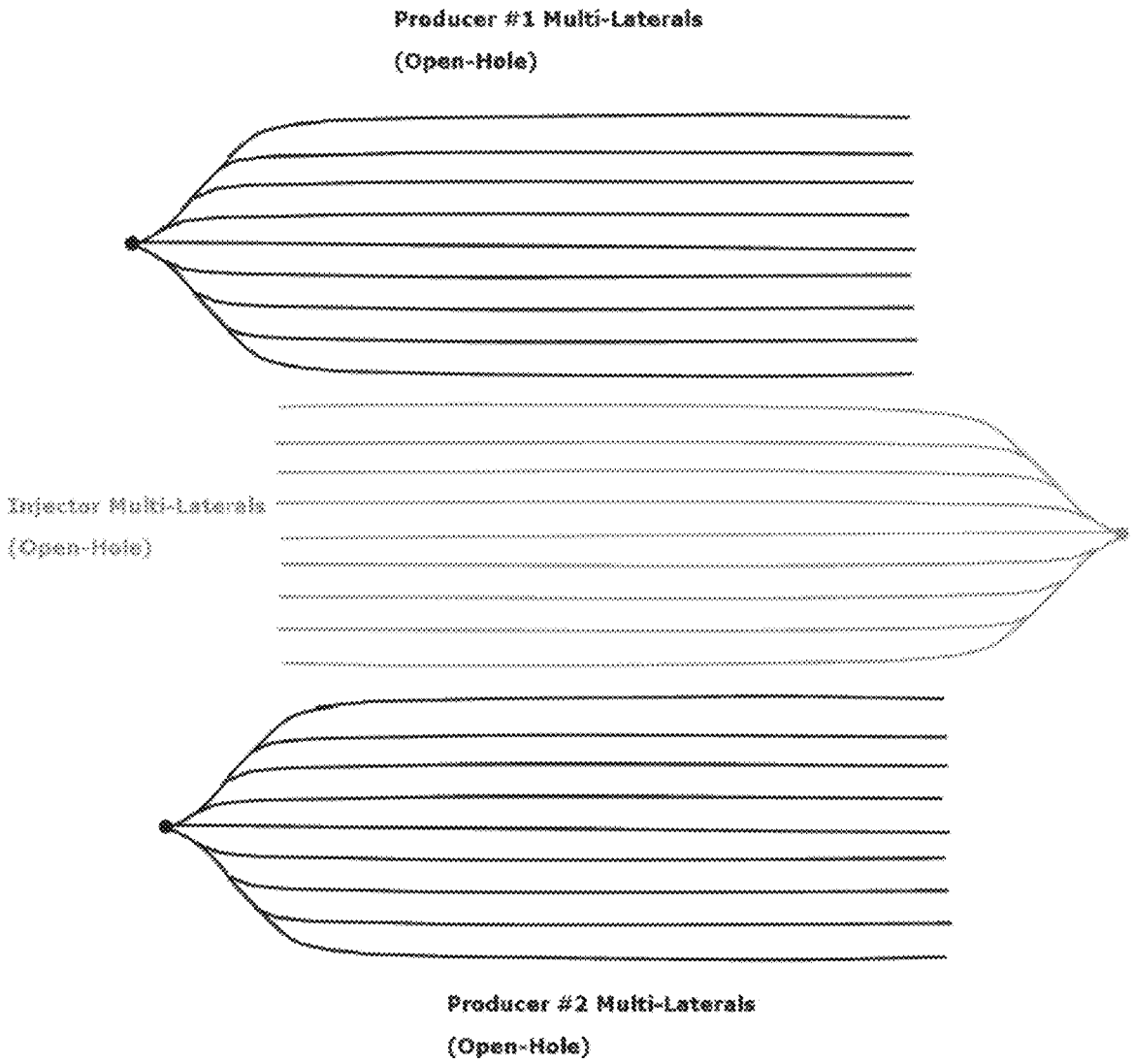

For the purpose of high hydrocarbon production, more laterals on the horizontal production well are desirable. However the number of laterals may also be limited by economics, limitations from drilling, surface limitations, or a combination thereof. For injection wells, the optimum number of laterals varies with the exploitation process utilized. In one particular application, several laterals on a horizontal injection well may be placed between successive laterals on a horizontal production well in such a way that results in a 1:1 production lateral to injection lateral ratio. Other applications may result in other ratios of production laterals to injection laterals. The number of laterals is determined by economics, to improve hydrocarbon production and reduce the cost of injection, drilling, completions and facility tie-ins. Examples of top views of horizontal multi-lateral production wells are shown in FIG. 9A and FIG. 9B. FIG. 9A shows a horizontal multi-lateral production well 902 with four laterals 904. FIG. 9B shows a multi-lateral production well 906 with 9 laterals 908. Examples of top views of different horizontal multi-lateral wells for GGD are shown in FIG. 10A, FIG. 10B, and FIG. 10C. FIG. 10A shows two examples of 1:1 production well lateral to injection well lateral ratios, with 4:4 and 9:9 production well laterals:injection well laterals, respectively. FIG. 10B shows examples of 4:1 and 9:1 production well lateral to injection well lateral ratios. FIG. 10C shows another example of a 1:1 (in this case 9:9) production well lateral to injection well lateral ratio. In this particular example, an injection well including 9 laterals is located between (offset from) two production wells, each including 9 laterals.

Figure 11:
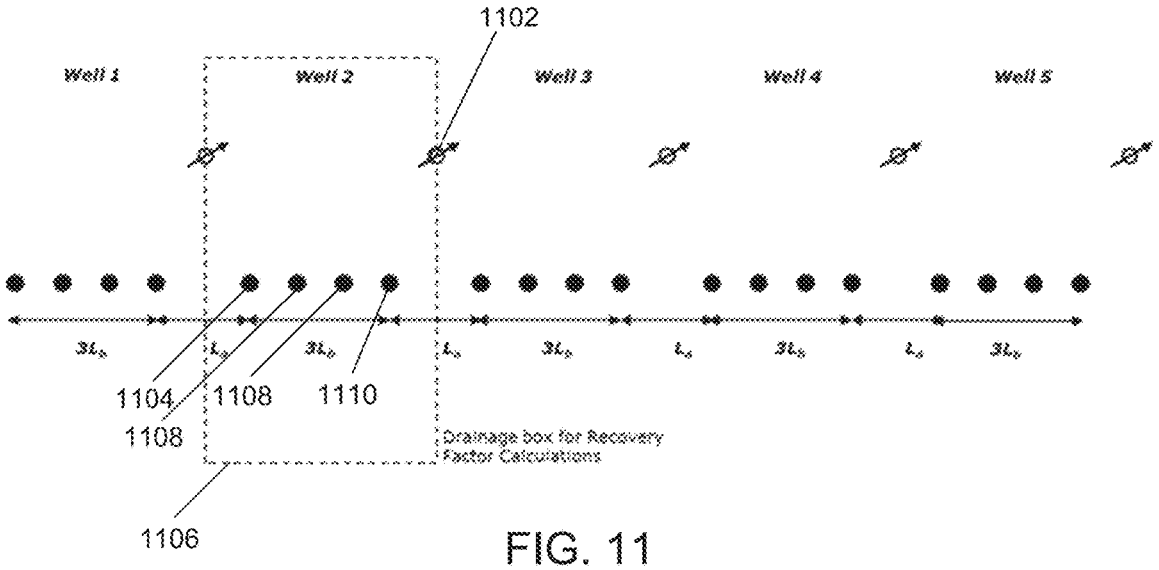
FIG. 11 is a schematic view of single lateral or cased injection wells and horizontal multi-lateral production wells located laterally between the injection wells.

A schematic of a horizontal multi-lateral well configuration is shown in FIG. 11. The schematic illustrates single lateral or cased injection wells 1102 with multi-lateral production wells 1104 located laterally between the injection wells 1102. The injection wells are adjacent to one another and the production wells are adjacent to one another in a configuration that may be typical for a multi-well battery or well pad setup. Length $L_a$ is the spacing between adjacent horizontal multi-lateral production wells 1104. The injection well 1102 is centered between (offset from) the multi-lateral production wells 1104 and is disposed above the production wells 1104. Length $L_b$ is the spacing between each lateral leg of the production well 1104. Both $L_a$ and $L_b$ may vary in an attempt to optimize oil rate, recovery and economic return. A particular $L_a/L_b$ ratio may be desirable.

Simulations were completed for one well pair (Well 2) including an injection well 1102 and multi-lateral production well 1104. A drainage box 1106 is represented in FIG. 11 for the purpose of determining the recovery factor (% oil recovered) for the well pair. Simulations assumed a fixed multi-lateral spacing ($L_b$) of 50 m, while $L_a$ was varied. The timing of the start of the GGD process was varied from 0-4 years after primary production was started. No restrictions were placed on gas production after gas breakthrough occurred at the outside lateral 1110 first, and production was continued from the horizontal multi-lateral production well 1104 until gas breakthrough occurred on the inside laterals 1108 of the production well 1104. Results from the simulations are shown in FIG. 12 through FIG. 15.

Figure 12A:
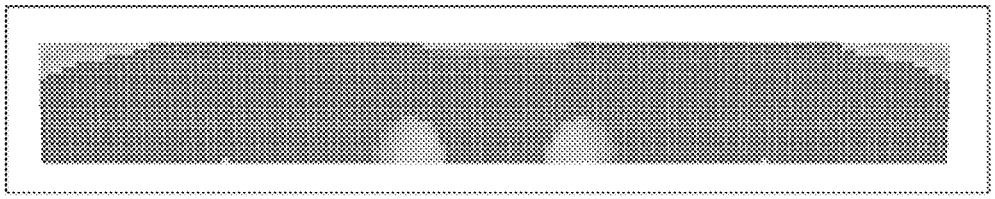
FIG. 12A shows a gas saturation profile at 3 years for horizontal multi-lateral production well simulations with a spacing between laterals of 100 m.
Figure 12B:
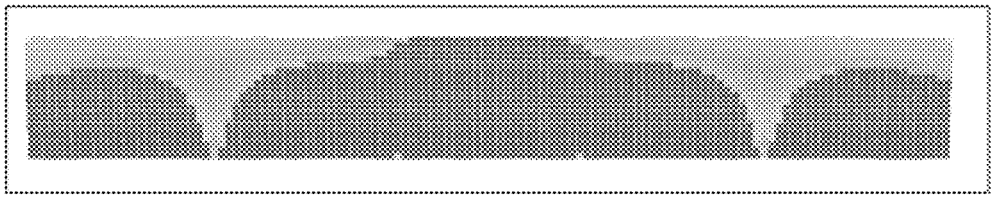
FIG. 12B shows a gas saturation profile at 7 years for horizontal multi-lateral production well simulations with a spacing between laterals of 100 m.
Figure 12C:
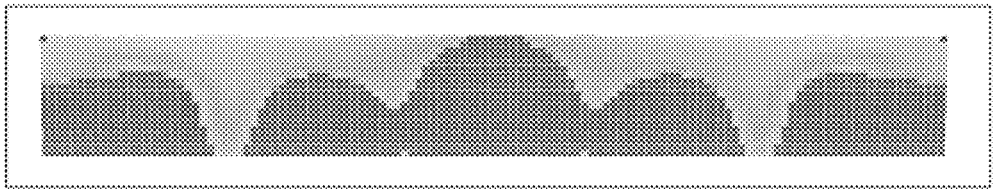
FIG. 12C shows a gas saturation profile at 10 years for horizontal multi-lateral production well simulations with a spacing between laterals of 100 m.
Figure 13A:
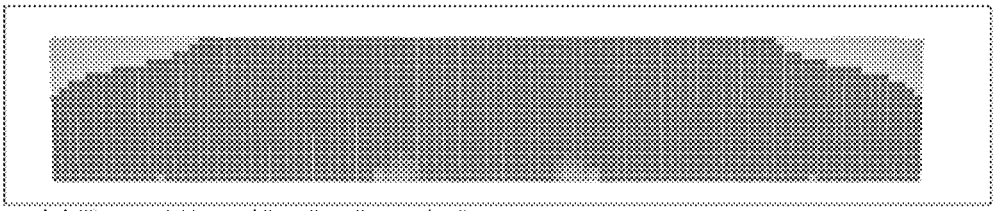
FIG. 13A shows a gas saturation profile at 3 years for horizontal multi-lateral production well simulations with a spacing between laterals of 50 m.
Figure 13B:
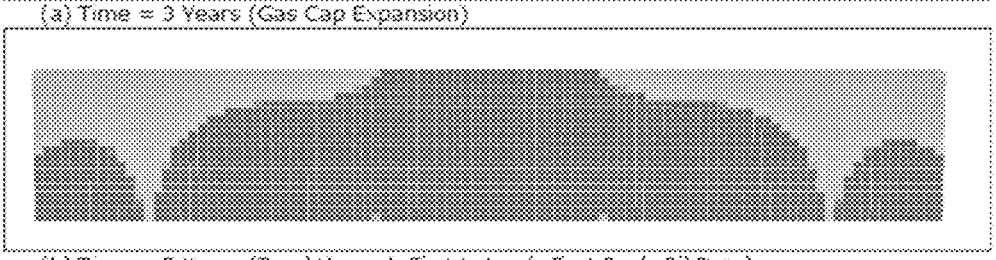
FIG. 13B shows a gas saturation profile at 5 years for horizontal multi-lateral production well simulations with a spacing between laterals of 50 m.
Figure 13C:
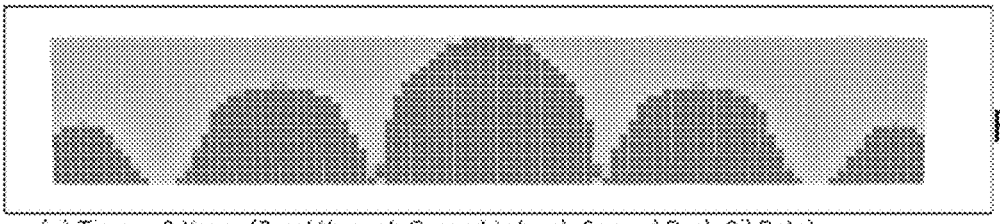
FIG. 13C shows a gas saturation profile at 8 years for horizontal multi-lateral production well simulations with a spacing between laterals of 50 m.
Figure 14:
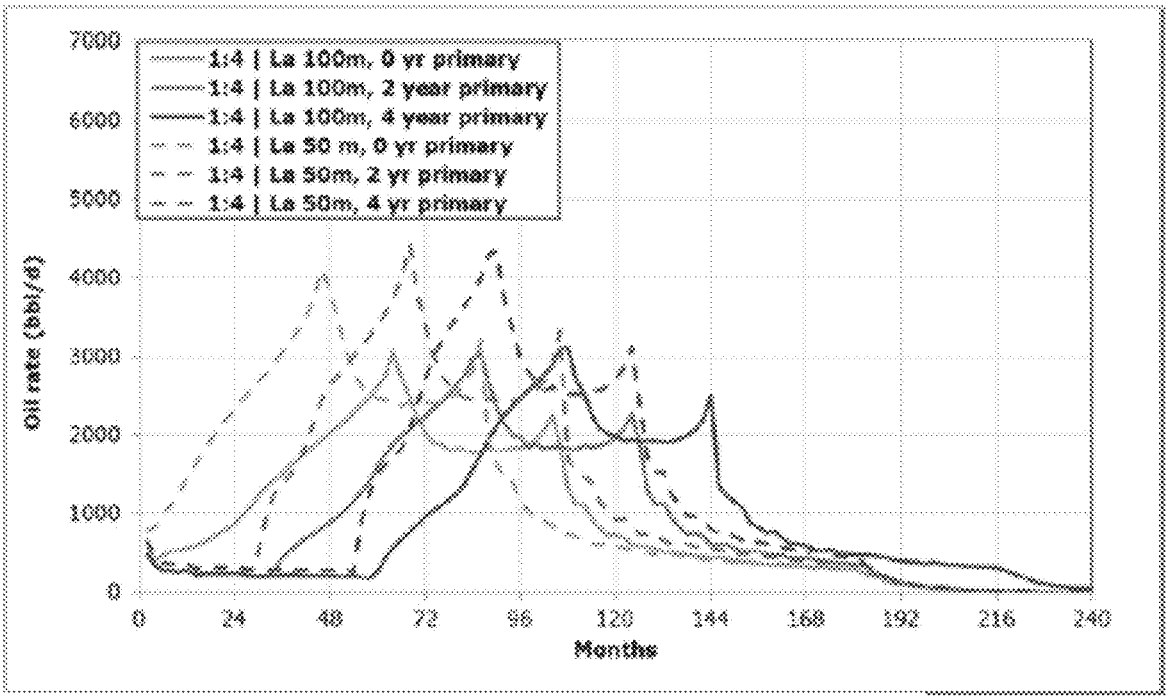
FIG. 14 is a graph of oil rate as a function of time for horizontal multi-lateral production well simulations.
Figure 15:
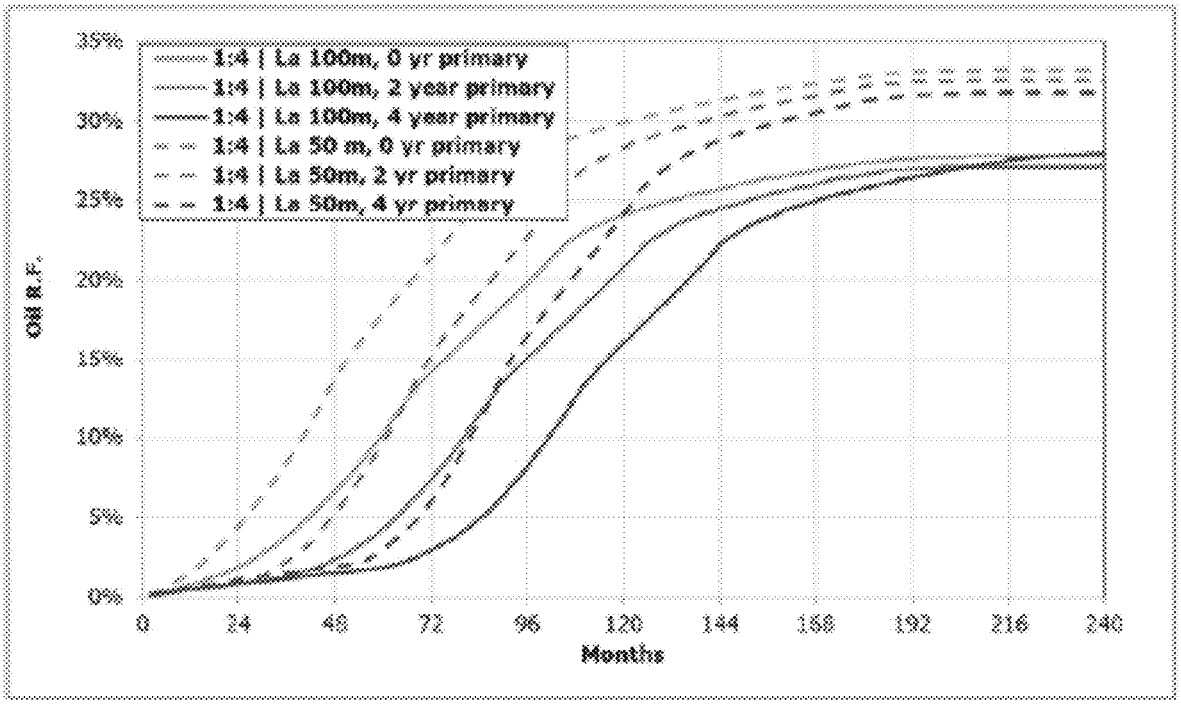
FIG. 15 is a graph of percent oil recovery (recovery factor or RF) as a function of time for horizontal multi-lateral production well simulations.

FIG. 12 and FIG. 13 show a view looking into the 4-lateral horizontal multi-lateral production well. The simulations showed an increasing oil production profile until peak oil was established, which roughly corresponded to the timing at which gas breakthrough occurred on the first (e.g., outside) lateral(s) of the production well 1104. Production continued assuming no constraints to gas production and a second peak oil rate was observed after another period of time. The second peak oil rate was smaller than the first peak oil rate and corresponded to the time at which breakthrough occurred on the inside lateral(s) of the production well 1104. Oil rate and recovery subsequently declined rapidly as production was no longer driven by gas displacement and was governed by gravity drainage alone.

The simulations showed that 50 m well spacing ($L_a$) resulted in higher peak oil rate (see FIG. 14) and higher ultimate oil recovery (see FIG. 15) compared to 100 m spacing for the same operating conditions. The reason for this higher peak oil rate relates to the potential gradient dP/dx, as described above. Smaller well spacing ($L_a$) results in a higher potential gradient, dP/dx, and thus a higher peak oil rate. The same peak oil rates are achievable at 100 m spacing, but with higher injection pressure, lower production pressure, or a combination thereof. Higher oil recovery observed in the 50 m well spacing simulations as compared with 100 m was a result of the efficiency of the gas sweep at the smaller spacing relative to the wider spacing.

Wellbore Stability

In the case of consolidated (fractured or unfractured) reservoirs, multi-lateral wells may be drilled and left uncased (open-hole) and maintain stable wellbore conditions. The stability of the wellbore is dependent on the stress state of the rock, the mechanical properties of the reservoir (rock and fluid), and the conditions within the wellbore, including temperature and pressure. In some applications, cased injection wells may be utilized. Cased production wells may also be utilized depending on the wellbore conditions. Cased injection or production wells may be utilized, for example, to improve wellbore stability, to deploy a liner or liners, inflow control devices, or any combination of wellbore completions to facilitate hydraulic flow.

Some drilling parameters may be evaluated before drilling, completion, and production in order to maintain wellbore stability and prevent compressive (wellbore breakouts) or tensile (fractures) failures in the rock. For instance, the most common technique of controlling such drilling parameters in drilling is with the mud weight drilled in the formation (also referred to as the mud window). By running and cementing successive intermediate casing strings through different geological formations, the mud window in a given geological formation can be widened without concern of failure in up-hole formations. Barring no changes to the formation during drilling, any well-servicing operations would also need to operate within the same mud window.

During production, the primary concern with the wellbore stability is in relation to wellbore breakout associated with significant reduction in flowing pressures in the open-hole laterals and corresponding stress concentrations around the wellbore. Operational strategy can seek to reduce significant temperature or pressure perturbations in the wellbore and carefully monitor production rates and sand cuts to inhibit wellbore failures.

Post Gas Breakthrough

Based on simulation modeling of the GGD process, a significant improvement is realized by the use of horizontal multi-lateral production wells in the economics of the process relative to single horizontal production wells. The cost of drilling several laterals is much lower than the cost of drilling multiple single horizontal wells. Control of gas breakthrough at the horizontal multi-lateral production well may depend on the multi-lateral configuration selected. Reference is made, for example, to the configuration illustrated in FIG. 10B, which shows a single horizontal injection well placed between two horizontal multi-lateral production wells. In this example, simulation models shows that the production laterals closest to the injector are the first to experience gas breakthrough. The production well may be monitored to detect gas breakthrough, for example, by:

1. Monitoring the production parameters at injection and production wells (oil rates, water rates, GOR, injection rates, temperatures and pressures);
2. Utilizing observation wells;
3. Analyzing monitoring data obtained from a 4D seismic survey;
4. Utilizing production logs (e.g., temperature logs, spinner logs); and
5. Employing injection and production communication tests utilizing tracers or pressure testing techniques.

After gas breakthrough is detected, production of the hydrocarbons may continue by a gas gravity drainage process in which hydrocarbons are drained toward the production well and continued production of the hydrocarbons through the production well is controlled.

Continued production of the hydrocarbons may be controlled by:

continuing production for a period of time, for example, in instances in which the production system (artificial lift, surface facilities, pipelines) are capable of handling increased GOR;

re-completing a lateral of the horizontal multi-lateral production well, for example, by replacing an artificial lift system, sizing for higher gas handling capabilities by the pump, implementing a gas lift process, installing a separate tubing string within the well to divert flow from a lateral of the well, installing gas separators and other downhole separation equipment upstream of the intake to divert gas up the casing, or a combination thereof;

optimizing the production system by debottlenecking surface processing facilities, pipelines, or a combination thereof, for example, by changing the size of downhole tubing, surface flowlines, feed pipelines, or a combination thereof;

isolating one or more laterals of the horizontal multi-lateral production well, utilizing tubing or coil-tubing deployed packer systems and continuing production with increased sweep efficiency until gas breakthrough is detected in a further (inside) lateral or laterals;

isolating one or more laterals of an injector well;

installing a flow control device in one or more laterals of the horizontal multi-lateral production well to reduce production from the one or more laterals;

sizing flow control devices based on pressure drop performance curves to constrain gas more than liquid flow rates;

re-drilling a section of one or more laterals of the horizontal multi-lateral production well, re-drilling a section of the injection well, or a combination thereof, to improve sweep efficiency and increase production;

installing a tubing string in a lateral section of the production well through to surface to divert flow from the main wellbore; and any combination of the above.

Figure 16:
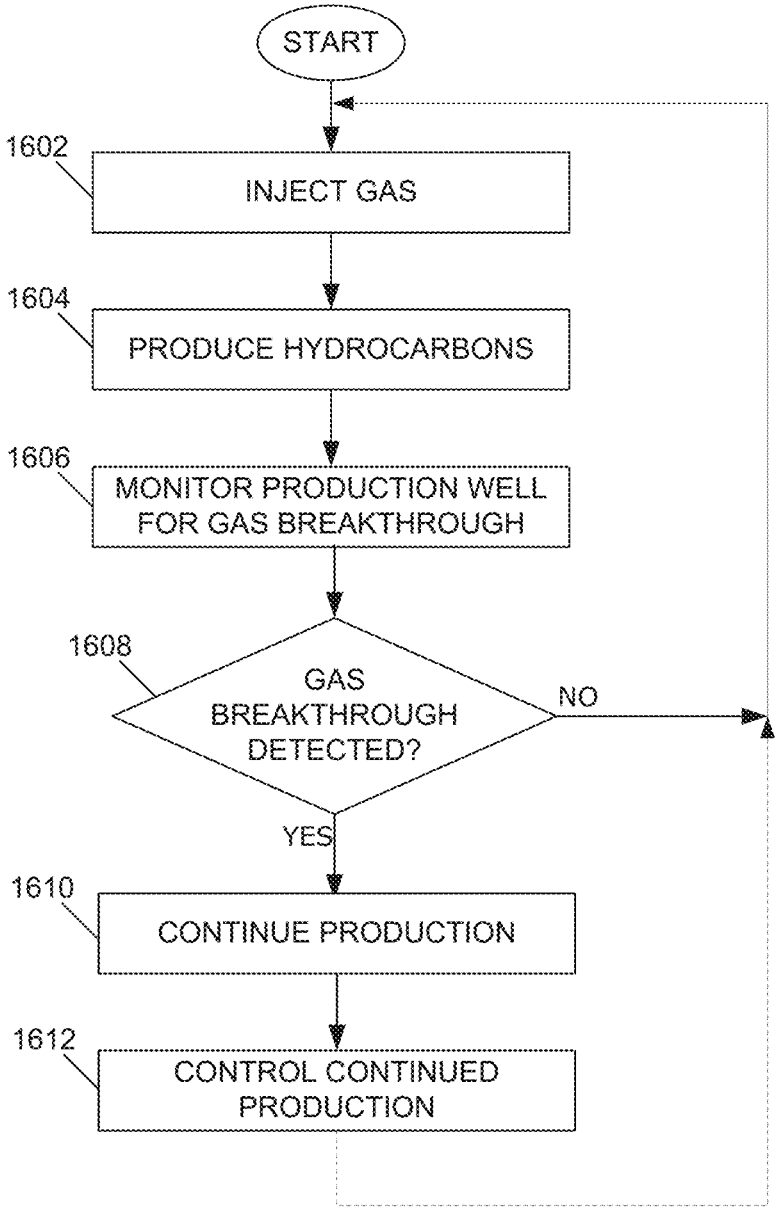
FIG. 16 is a flowchart showing a process for producing hydrocarbons from a subterranean hydrocarbon-bearing reservoir according to an embodiment.

A process for producing hydrocarbons from a subterranean hydrocarbon-bearing reservoir is shown in FIG. 16. The process may include additional or fewer elements than shown and described. The process is carried out utilizing an injection well and a horizontal multi-lateral production well that extend into a reservoir. The process shown in FIG. 16 may begin after a primary production method is carried out such that the process illustrated in FIG. 16 is part of a hydrocarbon production method. The primary production may include any process in which a production well is drilled and completed and production is started. The completion of the production well may include the addition of liners, perforating, fracturing, acidizing, or other processes. For example, the process described with reference to FIG. 16 may begin up to 10 years after an earlier, or primary production process is initiated. The GGD process may begin after some percentage or quantity of hydrocarbons are recovered, such as 10% of the hydrocarbons from the formation, after a given period of time, such as 4 years or less, or based on an economic criteria.

A gas is injected into the reservoir through the injection well at 1602. The gas is injected at a pressure below the minimum miscibility pressure such that the gas is generally immiscible with the hydrocarbons in the reservoir. Immiscible refers to fluids that cannot be mixed without separating from each other. Some gas dissolves into the oil during the process because the boundary in practicality is not fixed and strictly immiscible. The concentration at which miscibility occurs may depend on the chemical properties, physical conditions, or a combination thereof, of both the oil and the gas. The injection pressure of the gas is suitable to provide a differential pressure between the bottom-hole production well pressure at the multi-lateral production well, and the gas injection pressure to facilitate sweeping the hydrocarbons toward the production well prior to gas breakthrough at the production well.

Optionally, the bottom-hole production well pressure may be reduced to facilitate sweeping the hydrocarbons toward the production well prior to the gas breakthrough. The rate of oil recovery and a time to the gas breakthrough may be increased by increasing the gas injection pressure. Additionally, the differential pressure between the injection well and production well may be increased to increase the rate of oil recovery and the time to the gas breakthrough. The distance to the gas zone along a straight line between the production well and the injection well may be decreased to increase the rate of oil recovery and the time to the gas breakthrough.

Optionally, the bottom-hole production well pressure may be increased or decreased to reduce the differential pressure with underlying or overlying thief zones (e.g., a bottom water zone or aquifer below or near the production well) to facilitate optimal sweep of hydrocarbons to the production well. For example, the production well pressure may be increased to reduce the differential pressure with an underlying or overlying thief zone. Thief zones may include, for example, top water zones, bottom water zones, and gas caps (including top gas zones that have been produced, and therefore have reduced pressure).

A portion of the hydrocarbons are produced to surface through the production well at 1604.

Production of the hydrocarbons through the production well continues as the production well is monitored for gas breakthrough at 1606. Monitoring for gas breakthrough may including monitoring a production gas to oil ratio (GOR), a hydrocarbon production rate, a gas injection rate, a gas production rate, an injection pressure, a production pressure, an injection temperature, a production temperature, or a combination thereof. Alternatively, or in addition, monitoring for gas breakthrough may include monitoring data obtained from at least one of a seismic survey, an observation well, a production log, an injection well-production well communication test, shutting-in the injection well to observe pressure build-up, shutting in the production well to observe pressure build-up, or a combination thereof.

In response to detecting gas breakthrough at 1608, the process continues at 1610 and production of the hydrocarbons continues by gas gravity drainage in which hydrocarbons are drained toward the production well, thus recovering a further portion of the hydrocarbons.

Continued production of the hydrocarbons is controlled at 1612 after gas breakthrough, utilizing one or more of the processes described above. Depending on the method of controlling production, the process may continue at 1602. For example, after isolating one or more laterals of the horizontal multi-lateral production well and discontinuing production from that lateral at which gas breakthrough was detected, the process may continue at 1602.

EXAMPLE

The following example is provided to further illustrate an embodiment of the present invention. This example is intended to be illustrative and is not intended to limit the scope of the present invention.

A GGD pilot may be deployed in a conventional oil reservoir after two years of primary production from existing 4-lateral (4-leg) horizontal multi-lateral wells. Each lateral segment (leg) may have an effective length of 1,600 m and may be drilled open-hole with no horizontal completion. The average spacing between lateral legs may be 50 m over the 1,600 m interval as confirmed by drilling surveys. The production well may be drilled to a depth of 600 m and landed in the middle of a 20 m (depth) net pay zone. The production well may be completed with a progressive cavity pump (PCP) for handling inflow from all the laterals of the production well. The artificial lift completion may include a gas separator and multi-stage PCP with continuous rod to surface, resulting in production rates in the range of 60-360 bbl/d of emulsion assuming inflow conditions of 600 kPag. The production well may be reliably operated near these conditions during the first two years of production, with limited wear on the pump.

The initial reservoir pressure in the pay zone may be 3,500 kPa; however primary production may cause depletion of reservoir pressure to, for example, 3,000 kPa, as confirmed by shut-in pressure tests.

Two horizontal injection wells may be drilled into the upper 5 m of the geological formation of interest (reservoir or zone). The location of the wells may be selected by choosing the highest (or closest to the surface) reservoir structure in a given operating area. The injection wells may be cased and perforated over a 1,600 m effective length to provide high well outflow to the zone. One or more tubing strings may be deployed in the injection wells to facilitate gas distribution into the reservoir. The tubing completion may be easily adaptable to utilize flow control devices and other commercially available oil recovery technologies to facilitate gas distribution into the reservoir.

Surface facilities may be constructed to handle up to 10 MMscf/d of gas including primarily methane for injection purposes. The gas injected may include produced reservoir gases supplemented with natural gas sourced from a nearby pipeline or other source. The produced reservoir gases may be sourced from a central processing facility that treated oil, water and gas from another well pad in the same or different field.

GGD may be performed for years and a three-fold increase in oil rates, for example, may be observed from the production well since inception of the GGD process. GORs from the production well may be stable at 50 $m^3/m^3$ in the first 2.5 years but increase to 500 $m^3/m^3$ in the following 6 months. The producing GORs may increase from initial primary production of 20 $m^3/m^3$ based on reservoir depletion as the initial reservoir conditions may be measured at bubble point (no gas cap). Once gas breakthrough is observed, production may continue while the GOR is manageable. Observation wells and successive 3D seismic monitoring may be used to monitor the expanded gas zone from each injection well.

Both monitoring methods may provide an indication that the gas zone from one of the two injection wells (the first injection well) is in close proximity to the outermost lateral of the production well. Gas tracer tests may be conducted in the final 6 months of the 3 year period to confirm that gas breakthrough has occurred at the outermost lateral of the production well. Daily sampling on the production well may show signs of the gas tracer at 7 days, for example, after the gas tracer was injected at the wellhead of the first injection well. The operating strategy for the first injection well may include maintaining injection pressures of 6,000 kPa (bottom-hole), with gas production rates capped at 4.5 MMscf/d. Injection rates on the first injection well may increase from 2.8 MMscf/d to 4.3 MMscf/d to maintain the same bottom-hole pressures. Shut-in tests from the production well may be conducted to monitor the speed of the pressure build-up and may be compared with pre-GGD shut-ins. The tests may show that the pressure build-up within 24 hrs to, for example, 4,000 kPa exceeds the initial reservoir pressure. Thus it may be concluded that the gas zone from the first injection well has reached the production well and was likely produced through the outermost lateral. Pump failures may also provide an indication that the gas has become unmanageable.

The following method may be utilized to control production after the gas becomes unmanageable:

- re-complete the production well and install a bridge plug past the tee-off point of the second lateral of the horizontal multi-lateral production well to isolate production from the outermost lateral;
- upsize the artificial lift system on the production well, increase the number of pump stages to reduce the loading per stage, use a higher strength elastomer for the stator to reduce wear from slippage, and upsize the gas separator to handle up to 500 $m^3/m^3$ of gas;
- adjust gas injection on the first injection well by directing increased volumes to a tubing string landed at the toe of the well and reduce injection rates to 1.2 MMscf/d;

continue to monitor observation wells and conduct tracer test and shut-in (pressure build-up) tests on the production well after 30 days; and evaluate re-drill candidates for the production well. Re-drills may be conducted from the existing production well, or by drilling a new production well. Re-drills may seek to land one or more new lateral legs lower in the reservoir to capture more hydrocarbons and improve oil recovery.

The method of controlling production and mitigating the effects of gas breakthrough may be similar for other well configurations that include horizontal multi-lateral production wells, including those shown in FIG. 9A, FIG. 9B, FIG. 10A, FIG. 10B, and FIG. 10C, for example.

In examples in which GGD is deployed at or near the time of first production from the reservoir, the method for controlling production may not change significantly compared to the example described above. Advantageously, commencing GGD in a black oil reservoir earlier in the life of a well may maintain reservoir pressures and reduce the development or advancement of a reservoir gas cap towards the wells as a result of depletion.

In examples in which GGD is deployed later in production from a reservoir or later in the life of a well, gas breakthrough may have already occurred depending on the nature of the reservoir. For example, a well producing oil in a reservoir with an overlying gas cap may experience gas breakthrough from the gas cap on primary production. Similar methods to those that are utilized for primary production may be employed to continue production and mitigate gas breakthrough. However, use of the well configuration described in the example above for GGD may not be advantageous because an overlying gas cap may already be in communication with each lateral in the production well. Hence, re-drills or infill production wells may be utilized to improve oil recovery. For example, drilling new laterals from the existing production well or a new production well offset from the existing location or deeper into the reservoir may facilitate additional recovery from the zone and temporarily solve gas breakthrough effects.

Advantageously, hydrocarbon production utilizing the GGD process may be improved utilizing one or more multi-lateral production wells. After gas breakthrough is detected, production may be controlled via various methods as described herein to facilitate continued hydrocarbon production utilizing the GGD process.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A process for producing hydrocarbons from a subterranean hydrocarbon-bearing reservoir, the process comprising:

injecting a gas, at a gas injection pressure below a minimum miscibility pressure, into the reservoir through an injection well extending into the reservoir to form a gas zone in the reservoir, the gas injection pressure being suitable to provide a differential pressure, between a bottom-hole production well pressure at a horizontal multi-lateral production well extending into the reservoir and the gas injection pressure, to facilitate sweeping the hydrocarbons toward the production well prior to a gas breakthrough at the production well;

producing a portion of the hydrocarbons to surface through the production well;

monitoring the production well for the gas breakthrough, and after the gas breakthrough is detected:

producing a further portion of the hydrocarbons by a gas gravity drainage process in which hydrocarbons are drained toward the production well; and controlling continued production of the hydrocarbons through the production well, wherein controlling continued production of the hydrocarbons comprises at least one of: re-completing a lateral of the horizontal multi-lateral production well, isolating the lateral of the horizontal multi-lateral production well, installing an inflow control device in the lateral of the horizontal multi-lateral production well, re-drilling a section of the lateral of the horizontal multi-lateral production well, re-drilling a section of the injection well, or a combination thereof.

2. The process according to claim 1, wherein re-completing comprises at least one of re-sizing a lift assembly, installing a downhole gas separator, implementing a gas lift process, installing a separate tubing string within the well to divert flow from a lateral of the well, or a combination thereof.

3. A process for producing hydrocarbons from a subterranean hydrocarbon-bearing reservoir, the process comprising:

injecting a gas, at a gas injection pressure below a minimum miscibility pressure, into the reservoir through an injection well extending into the reservoir to form a gas zone in the reservoir, the gas injection pressure being suitable to provide a differential pressure, between a bottom-hole production well pressure at a horizontal multi-lateral production well extending into the reservoir and the gas injection pressure, to facilitate sweeping the hydrocarbons toward the production well prior to a gas breakthrough at the production well;

producing a portion of the hydrocarbons to surface through the production well;

monitoring the production well for the gas breakthrough, and after the gas breakthrough is detected:

producing a further portion of the hydrocarbons by a gas gravity drainage process in which hydrocarbons are drained toward the production well; and controlling continued production of the hydrocarbons through the production well, wherein monitoring the production well for the gas breakthrough comprises monitoring at least one of: a production gas to oil ratio (GOR), a hydrocarbon production rate, a gas injection rate, a gas production rate, an injection pressure, a production pressure, a production temperature, or a combination thereof.

4. The process according to claim 3, wherein detecting the gas breakthrough comprises analyzing monitoring data obtained from at least one of a seismic survey, an observation well, a production log, an injection well-production well communication test, shutting in the production well, shutting in the injection well, or a combination thereof.

5. The process according to claim 3, wherein the injection well comprises a horizontal multi-lateral injection well.

6. The process according to claim 5, wherein lateral legs of the multi-lateral injection well are laterally offset from and between lateral legs of the multi-lateral production well.

7. The process according to claim 5, wherein the ratio of lateral legs of the multi-lateral production well to lateral legs of the multi-lateral injection well is >1:1.

8. The process according to claim 5, wherein the ratio of lateral legs of the multi-lateral production well to lateral legs of the multi-lateral injection well is 1:1.

9. The process according to claim 5, wherein the vertical distance between a horizontal segment of the injection well and a horizontal segment of the production well is selected based on a calculated rate of oil recovery and a time to the gas breakthrough.

10. The process according to claim 3, wherein the injection well comprises an injection well including a single lateral and the lateral of the injection well is disposed laterally between two multi-lateral production wells.

11. The process according to claim 3, comprising increasing the gas injection pressure to increase a rate of oil recovery and a time to the gas breakthrough.

12. The process according to claim 3, comprising increasing the differential pressure between the injection well and production well to increase a rate of oil recovery and a time to the gas breakthrough.

13. The process according to claim 3, comprising decreasing the distance to the gas zone along a straight line between the production well and the injection well to increase the rate of oil recovery and the time to the gas breakthrough.

14. The process according to claim 3, comprising increasing the production well pressure to reduce the differential pressure with an underlying or overlying thief zone.

15. The process according to claim 3, comprising recovering hydrocarbons from the subterranean hydrocarbon-bearing for period of time of 4 years or less prior to injecting the gas and recovering the portion of the hydrocarbons.

16. The process according to claim 3, comprising monitoring the production well prior to injecting the gas and, in response to first production of hydrocarbons through the production well, commencing injecting the gas.

17. The process according to claim 3, wherein the gas is methane.

18. A process for producing hydrocarbons from a subterranean hydrocarbon-bearing reservoir, the process comprising:

injecting a gas, at a gas injection pressure below a minimum miscibility pressure, into the reservoir through an injection well extending into the reservoir to form a gas zone in the reservoir, the gas injection pressure being suitable to provide a differential pressure, between a bottom-hole production well pressure at a horizontal multi-lateral production well extending into the reservoir and the gas injection pressure, to facilitate sweeping the hydrocarbons toward the production well prior to a gas breakthrough at the production well;

producing a portion of the hydrocarbons to surface through the production well;

monitoring the production well for the gas breakthrough, and after the gas breakthrough is detected:

producing a further portion of the hydrocarbons by a gas gravity drainage process in which hydrocarbons are drained toward the production well; and controlling continued production of the hydrocarbons through the production well, and reducing the bottom-hole production well pressure to facilitate sweeping the hydrocarbons toward the production well prior to the gas breakthrough.

* * * * *